US011536438B2

(12) United States Patent
Frankiewicz et al.

(10) Patent No.: US 11,536,438 B2
(45) Date of Patent: Dec. 27, 2022

(54) LIGHTING APPARATUS HAVING AN OPTIC WITH A CENTERED LIGHT SOURCE AND AN OFF-CENTER LIGHT SOURCE

(71) Applicant: ABL IP Holding LLC, Atlanta, GA (US)

(72) Inventors: Gregory P. Frankiewicz, Elmhurst, IL (US); John G. Serra, Pingree Grove, IL (US)

(73) Assignee: ABL IP HOLDING LLC, Atlanta, GA (US)

( * ) Notice: Subject to any disclaimer, the term of this patent is extended or adjusted under 35 U.S.C. 154(b) by 0 days.

(21) Appl. No.: 17/079,764

(22) Filed: Oct. 26, 2020

(65) Prior Publication Data

US 2022/0128219 A1 Apr. 28, 2022

(51) Int. Cl.
*F21V 5/04* (2006.01)
*F21Y 113/10* (2016.01)

(52) U.S. Cl.
CPC ..... *F21V 5/046* (2013.01); *F21Y 2113/10* (2016.08)

(58) Field of Classification Search
CPC ... F21V 5/046; F21Y 2113/10; F21Y 2115/10
See application file for complete search history.

(56) References Cited

U.S. PATENT DOCUMENTS 1,422,480 A 7/1922 Rutherford
7,080,921 B2 7/2006 Feldstein
7,237,924 B2 7/2007 Martineau et al.
7,286,296 B2 10/2007 Chaves et al.
7,832,878 B2 11/2010 Brukilacchio et al.
7,918,583 B2 4/2011 Chakmakjian et al.
8,215,802 B2 7/2012 Bailey
8,231,250 B2 7/2012 Bailey
8,348,488 B2 1/2013 Buelow, II et al.
8,430,536 B1 4/2013 Zhao
8,641,231 B2 2/2014 Ariyoshi et al.
8,657,476 B2 2/2014 Buelow et al.
8,710,754 B2 4/2014 Baddela et al.
8,870,410 B2 10/2014 Auyeung
8,870,617 B2 10/2014 Harbers
(Continued)

FOREIGN PATENT DOCUMENTS

CN 101349389 * 4/2004 ..... F21S 41/151
WO WO 2015/140760 * 3/2015 ..... F21K 9/90

OTHER PUBLICATIONS

U.S. Appl. No. 16/925,807, Non-Final Office Action dated Jul. 28, 2021, 6 pages.
(Continued)

*Primary Examiner* — Zheng Song
(74) *Attorney, Agent, or Firm* — Kilpatrick Townsend & Stockton LLP

(57) ABSTRACT

Disclosed herein are lighting apparatuses that have a centered light source and at least one off-center light source. According to certain embodiments, a lighting apparatus includes a first light fixture having a first light source arranged at a first position that is centered with respect to a first optical axis of a first optic, and a second light source arranged at a second position that is off-center with respect to the first optical axis of the first optic. The first optic is configured to receive light emitted by the first light source and the second light source.

19 Claims, 14 Drawing Sheets

(56) References Cited

U.S. PATENT DOCUMENTS

| | | | | |
|---|---|---|---|---|
| 9,801,250 | B1* | 10/2017 | Halliwell | F21V 19/006 |
| 9,801,259 | B2 | 10/2017 | Rasmussen | |
| 10,302,278 | B2 | 5/2019 | Lim et al. | |
| 2006/0139953 | A1* | 6/2006 | Chou | G02F 1/133526 362/613 |
| 2009/0168414 | A1* | 7/2009 | Bailey | F21V 7/0091 362/231 |
| 2010/0165623 | A1 | 7/2010 | Bremerich et al. | |
| 2011/0182065 | A1* | 7/2011 | Negley | F21K 9/62 362/231 |
| 2013/0153934 | A1* | 6/2013 | Meitl | G09F 9/35 257/84 |
| 2015/0054005 | A1* | 2/2015 | Kim | H01L 33/58 257/89 |
| 2015/0117000 | A1* | 4/2015 | Luo | G02B 19/0028 362/235 |
| 2016/0312979 | A1* | 10/2016 | Ebner | G02B 19/0066 |
| 2017/0059120 | A1* | 3/2017 | Kataoka | F21V 7/0091 |
| 2017/0067621 | A1* | 3/2017 | Anselm | F21V 11/14 |
| 2018/0192484 | A1* | 7/2018 | Stopa | F21V 5/04 |
| 2018/0313519 | A1 | 11/2018 | Lacroix | |
| 2019/0171010 | A1* | 6/2019 | Nambara | F21V 5/04 |
| 2019/0383465 | A1* | 12/2019 | Van Der Sijde | F21L 4/00 |

OTHER PUBLICATIONS

U.S. Appl. No. 16/925,807, Notice of Allowance, dated Dec. 13, 2021, 5 pages.

* cited by examiner

PRIOR ART

PRIOR ART

PRIOR ART

305

300

PRIOR ART

405

400

605

600

705

700

905

900

1005

1000

LIGHTING APPARATUS HAVING AN OPTIC WITH A CENTERED LIGHT SOURCE AND AN OFF-CENTER LIGHT SOURCE

FIELD

Embodiments of the present invention relate to lighting apparatuses for producing various light distributions.

BACKGROUND

Related art lighting apparatuses that generate white light are designed to produce a rotationally symmetric light distribution having a single correlated color temperature (CCT). These related art lighting apparatuses generally use a rotationally symmetric optic to collect and distribute the light from a rotationally symmetric light source. However, it may be advantageous to provide white light tuning, in which the CCT of the output beam from the lighting apparatus can be adjusted. For example, a checkerboard pattern of light sources having different CCTs, such as a 2×2, 3×3, or 4×4 pattern of light sources, may be used with a rotationally symmetric optic to try to create a rotationally symmetric light distribution. However, this results in an increase in the size of the optic that is used to collect the light from the light sources, and the resulting light distribution may appear as a checkerboard pattern. An additional issue with this approach is that if only one color is turned on at a time to achieve a more uniform light distribution, the amount of output light is reduced by a factor of two.

SUMMARY

This disclosure relates generally to lighting apparatuses that have a centered light source and at least one off-center light source. According to some embodiments, a lighting apparatus includes a first light fixture having a first light source arranged at a first position that is centered with respect to a first optical axis of a first optic, and a second light source arranged at a second position that is off-center with respect to the first optical axis of the first optic. The first optic is configured to receive light emitted by the first light source and the second light source.

The first optic may have a geometry that is rotationally symmetric about the first optical axis of the first optic. The first optic may be configured to use total internal reflection (TIR). The first light source may be configured to emit light having a first correlated color temperature (CCT), and the second light source may be configured to emit light having a second CCT that is different from the first CCT. Alternatively, the first light source and the second light source may be configured to emit light having the same CCT.

The lighting apparatus may also include a second light fixture having a third light source arranged at a third position that is centered with respect to a second optical axis of a second optic, and a fourth light source arranged at a fourth position that is off-center with respect to the second optical axis of the second optic. The second optic may be configured to receive light emitted by the third light source and the fourth light source. The first light source and the second light source may configured to emit light having a first CCT, and the third light source and the fourth light source may be configured to emit light having a second CCT that is different from the first CCT. Alternatively, the first light source and the third light source may be configured to emit light having a first CCT, and the second light source and the fourth light source are configured to emit light having a second CCT that is different from the first CCT.

According to other embodiments, a lighting apparatus includes a first light fixture having a first light source arranged at a first position that is centered with respect to a first optical axis of a first optic, and a second light source arranged at a second position that is off-center with respect to the first optical axis of the first optic. The first light source is configured to emit light having a first CCT and the second light source is configured to emit light having a second CCT. The first optic is configured to receive the light emitted by the first light source and the second light source. The lighting apparatus also includes a second light fixture having a third light source arranged at a third position that is centered with respect to a second optical axis of a second optic, and a fourth light source arranged at a fourth position that is off-center with respect to the second optical axis of the second optic. The third light source is configured to emit light having the second CCT and the second light source is configured to emit light having the first CCT. The second optic is configured to receive the light emitted by the third light source and the fourth light source.

The first position and the third position may be arranged along a first linear direction, the first position and the second position may be arranged along a second linear direction that is perpendicular to the first linear direction, and the second position and the fourth position may be arranged along a third linear direction that is parallel to the first linear direction. The first CCT may be between 1800 K and 3500 K, and the second CCT may be between 4500 K and 7000 K. The lighting apparatus may also include a first texture that is configured to receive light from a first light emitting surface of the first optic, and a second texture that is configured to receive light from a second light emitting surface of the second optic.

The lighting apparatus may also include a third light fixture having a fifth light source arranged at a fifth position that is centered with respect to a third optical axis of a third optic, and a sixth light source arranged at a sixth position that is off-center with respect to the third optical axis of the third optic. The fifth light source may be configured to emit light having the first CCT and the sixth light source may be configured to emit light having the second CCT. The third optic may be configured to receive the light emitted by the fifth light source and the sixth light source. In addition, the lighting apparatus may include a fourth light fixture having a seventh light source arranged at a seventh position that is centered with respect to a fourth optical axis of a fourth optic, and an eighth light source arranged at an eighth position that is off-center with respect to the fourth optical axis of the fourth optic. The seventh light source may be configured to emit light having the second CCT and the eighth light source may be configured to emit light having the first CCT. The fourth optic may be configured to receive the light emitted by the seventh light source and the eighth light source. The second position, the first position, the fourth position, the third position, the fifth position, and the seventh position may be arranged in order along a first linear direction, and the sixth position and the eighth position may be arranged along a second linear direction that is parallel to the first linear direction. The fifth position and the sixth position may be arranged along a third linear direction that is perpendicular to the first linear direction, and the seventh position and the eighth position may be arranged along a fourth linear direction that is perpendicular to the first linear direction and parallel to the third linear direction.

According to other embodiments, a lighting apparatus includes a first light fixture having a first light source arranged at a first position that is centered with respect to a first optical axis of a first optic, a second light source arranged at a second position that is off-center with respect to the first optical axis of the first optic, and a third light source arranged at a third position that is off-center with respect to the first optical axis of the first optic. The first optic is configured to receive light emitted by the first light source, the second light source, and the third light source. The lighting apparatus also includes a second light fixture having a fourth light source arranged at a fourth position that is centered with respect to a second optical axis of a second optic, a fifth light source arranged at a fifth position that is off-center with respect to the second optical axis of the second optic, and a sixth light source arranged at a sixth position that is off-center with respect to the second optical axis of the second optic. The second optic is configured to receive light emitted by the fourth light source, the fifth light source, and the sixth light source. The lighting apparatus also includes a third light fixture having a seventh light source arranged at a seventh position that is centered with respect to a third optical axis of a third optic, an eighth light source arranged at an eighth position that is off-center with respect to the third optical axis of the third optic, and a ninth light source arranged at a ninth position that is off-center with respect to the third optical axis of the third optic. The third optic is configured to receive light emitted by the seventh light source, the eighth light source, and the ninth light source.

The second position, the first position, the fifth position, the fourth position, the eighth position, and the seventh position may be arranged in order along a first linear direction, the third position, the sixth position, and the ninth position may be arranged along a second linear direction that is parallel to the first linear direction, the first position and the third position may be arranged along a third linear direction that is perpendicular to the first linear direction, the fourth position and the sixth position may be arranged along a fourth linear direction that is perpendicular to the first linear direction and parallel to the third linear direction, and the seventh position and the ninth position may be arranged along a fifth linear direction that is perpendicular to the first linear direction and parallel to the third linear direction.

The first light source, the sixth light source, and the eighth light source may be configured to emit light having a first CCT, the second light source, the fourth light source, and the ninth light source may be configured to emit light having a second CCT that is different from the first CCT, and the third light source, the fifth light source, and the seventh light source may be configured to emit light having a third CCT that is different from the first CCT and the second CCT. The first CCT may be between 1800 K and 3500 K, the second CCT may be between 4500 K and 5500 K, and the third CCT may be between 5600 K and 7000 K.

The first light source, the sixth light source, and the eighth light source may be configured to emit light having a first wavelength, the second light source, the fourth light source, and the ninth light source may be configured to emit light having a second wavelength, and the third light source, the fifth light source, and the seventh light source may be configured to emit light having a third wavelength. The first wavelength may be within a first portion of the electromagnetic spectrum corresponding to red light, the second wavelength may be within a second portion of the electromagnetic spectrum corresponding to green light, and the third wavelength may be within a third portion of the electromagnetic spectrum corresponding to blue light.

This summary is neither intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim. The foregoing, together with other features and examples, will be described in more detail below in the following specification, claims, and accompanying drawings.

BRIEF DESCRIPTION OF THE DRAWINGS

Illustrative embodiments are described in detail below with reference to the following figures.

The figures depict embodiments of the present disclosure for purposes of illustration only. One skilled in the art will readily recognize from the following description that alternative embodiments of the structures and methods illustrated may be employed without departing from the principles, or benefits touted, of this disclosure.

DETAILED DESCRIPTION

Figure 1B:
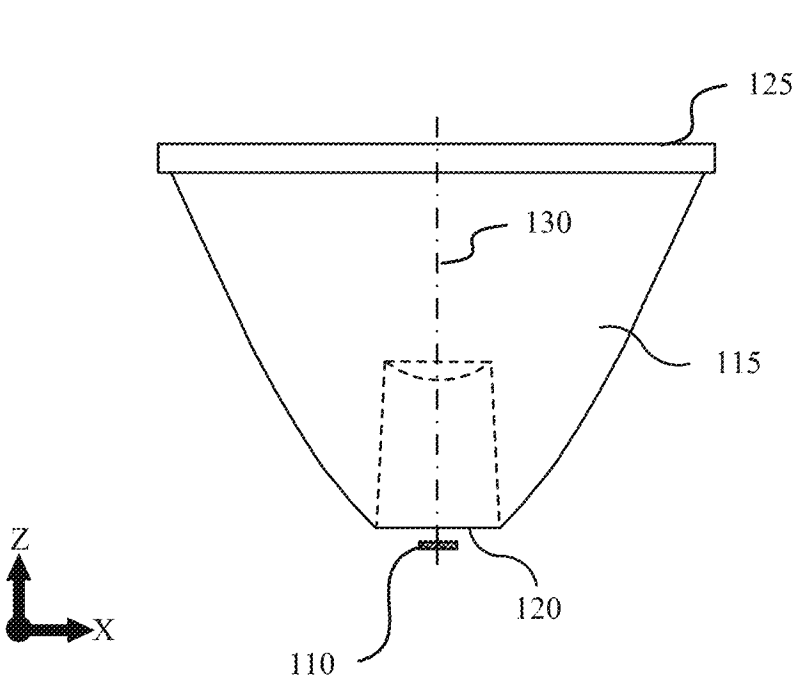
FIG. 1B PRIOR ART
FIGS. 1A and 1B are schematic diagrams of an example of a prior art lighting apparatus that emits white light having a single CCT.
Figure 1A:
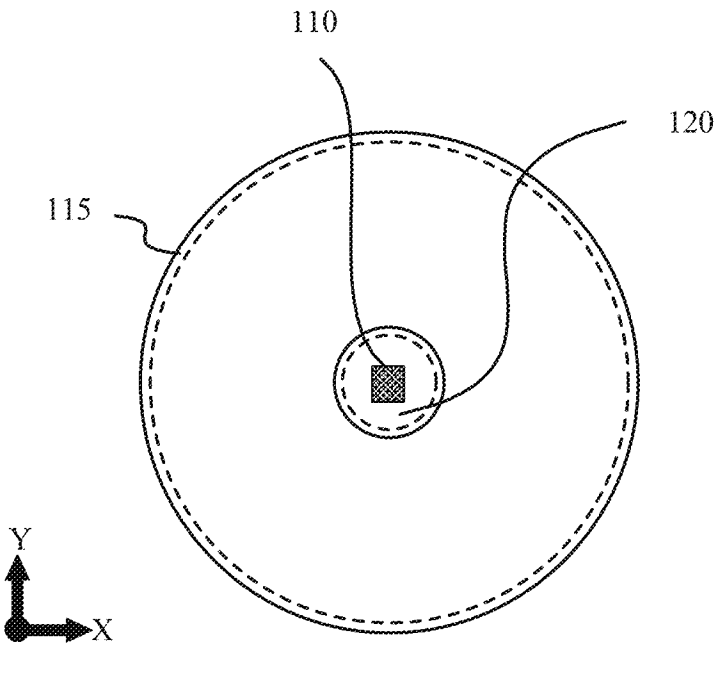

FIGS. 1A and 1B are schematic diagrams of an example of a prior art lighting apparatus 100 that emits white light having a single correlated color temperature (CCT). FIG. 1A shows a top view of the prior art lighting apparatus 100, and FIG. 1B shows a side view of the prior art lighting apparatus 100. As shown in FIGS. 1A and 1B, the prior art lighting apparatus 100 includes a light source 110 and an optic 115. The light source 110 may be a light emitting diode (LED) that is rotationally symmetric within the X-Y plane. For example, the LED may have a square shape. The optic 115 may use total internal reflection (TIR) that is also rotationally symmetric within the X-Y plane. The optic 115 may have a base portion 120 and a light emitting surface 125. Both the light source 110 and the optic 115 may be centered with respect to an optical axis 130 of the optic 115. The light source 110 may emit light in a direction that is parallel to the optical axis 130. The light source 110 may be positioned at the base of the optic 115 such that the light source 110 is positioned at the focal point of the optic 115. Alternatively, the light source 110 may be positioned above or below the focal point of the optic 115. The focal point of the optic 115 may also be centered with respect to the optical axis 130. In this example, the CCT of the light source 110 is 3000 K.

Figure 2:
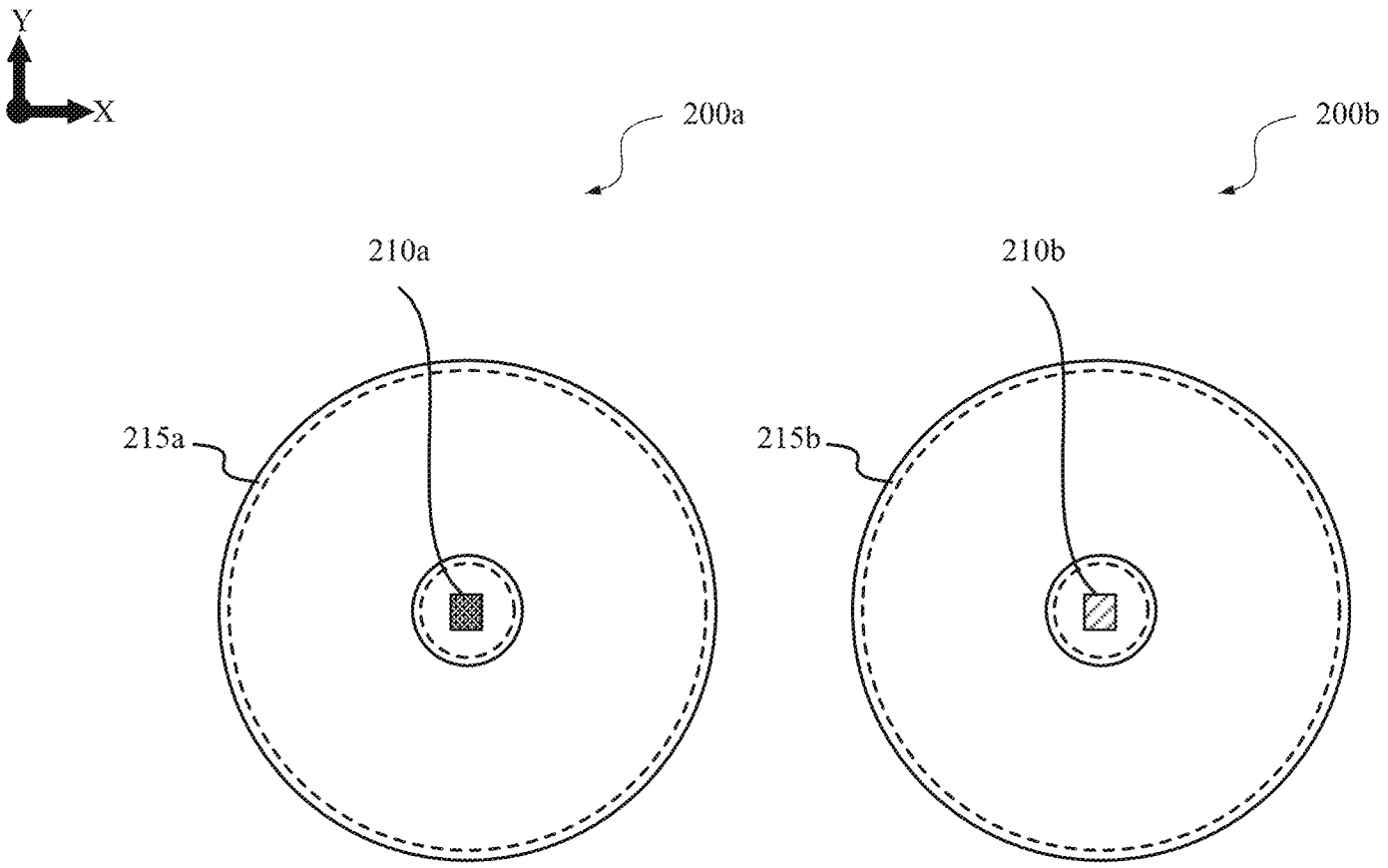
FIG. 2 is a schematic diagram of an example of another prior art lighting apparatus that may be used for white light tuning.

FIG. 2 is a schematic diagram of an example of another prior art lighting apparatus that may be used for white light tuning. In the prior art lighting apparatus, each of a plurality of light sources is provided with a corresponding rotationally symmetric optic. FIG. 2 shows a top view of the prior art lighting apparatus. As shown in FIG. 2, the prior art lighting apparatus may include a first light fixture 200*a* and a second light fixture 200*b*, each of which may have the same design as the prior art lighting apparatus 100 discussed above with reference to FIGS. 1A and 1B. The first light fixture 200*a* may include a first light source 210*a* and a first optic 215*a*. The first light source 210*a* may be centered with respect to an optical axis of the first optic 215*a*. The first light source 210*a* may be positioned at the focal point of the first optic 215*a*. Alternatively, the first source 210*a* may be positioned above or below the focal point of the first optic 215*a*. The first light source 210*a* and the first optic 215*a* may be rotationally symmetric. Similarly, the second light fixture 200*b* may include a second light source 210*b* and a second optic 215*b*. The second light source 210*b* may be centered with respect to an optical axis of the second optic 215*b*. The second light source 210*b* may be positioned at the focal point of the second optic 215*b*. Alternatively, the second source 210*b* may be positioned above or below the focal point of the second optic 215*b*. The second light source 210*b* and the second optic 215*b* may be rotationally symmetric.

The first light source 210*a* may have a first CCT, while the second light source 210*b* may have a second CCT. In this example, the first CCT of the first light source 210*a* may be 3000 K and the second CCT of the second light source 210*b* may be 6500 K. More generally, the first light source 210*a* may have a warmer hue that has a yellow appearance, while the second light source 210*b* may have a cooler hue that has a blue appearance. For example, the first light source 210*a* may have a CCT between 1800 K and 3500 K, and the second light source 210*b* may have a CCT between 4500 K and 7000 K. Light from the first light fixture 200*a* and light from the second light fixture 200*b* overlaps in the far field. The CCT of the resulting beam may be varied by adjusting the intensity of the first light source 210*a* and/or the second light source 210*b*. In an extreme case, one of the light sources 210*a* or 210*b* may be turned off, such that the resulting beam has the CCT of the other one of the light sources 210*a* or 210*b* that is turned on.

Figure 3B:
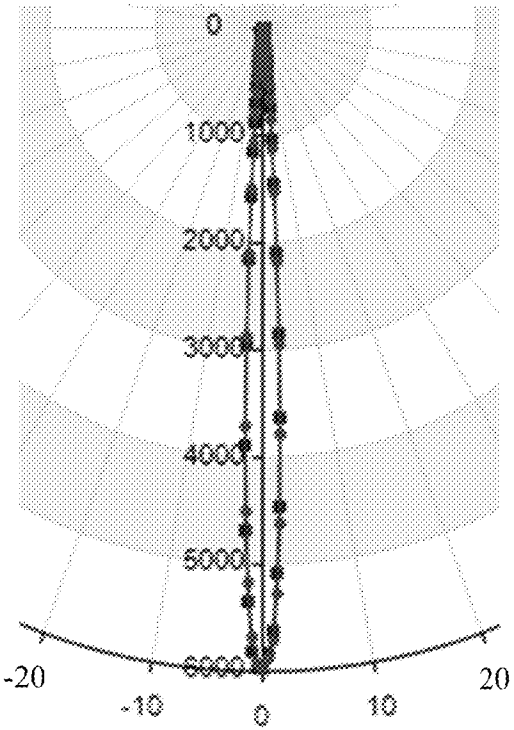
FIG. 3B PRIOR ART
FIGS. 3A and 3B are graphs illustrating simulations of a light distribution from the prior art lighting apparatus shown in FIG. 2.
Figure 3A:
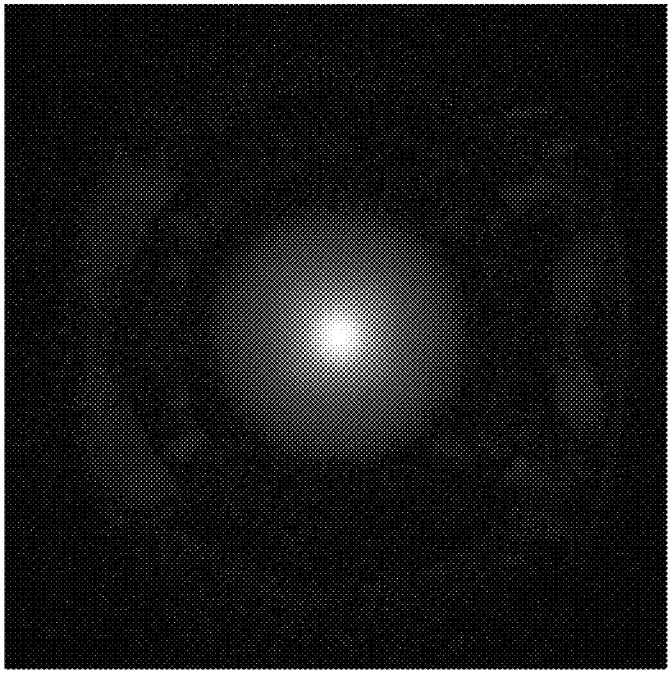
Figure 3A:
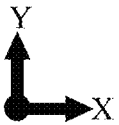

FIGS. 3A and 3B are graphs illustrating simulations of a light distribution from the prior art lighting apparatus shown in FIG. 2. FIG. 3A shows a simulated true color plot 300 of the light distribution from the prior art lighting apparatus on an 8' by 8' floor from a height of 10', and FIG. 3B shows a simulated polar intensity plot 305 of the light distribution from the prior art lighting apparatus. As shown in FIGS. 3A and 3B, the prior art lighting apparatus provides a tight light distribution that has a full-width at half-maximum (FWHM) of 5.9° in both the X direction and the Y direction. However, the light distribution is warmer on the left-hand side and cooler on the right-hand side, due to the side-by-side arrangement of the first light fixture 200*a* and the second light fixture 200*b*.

Figure 4B:
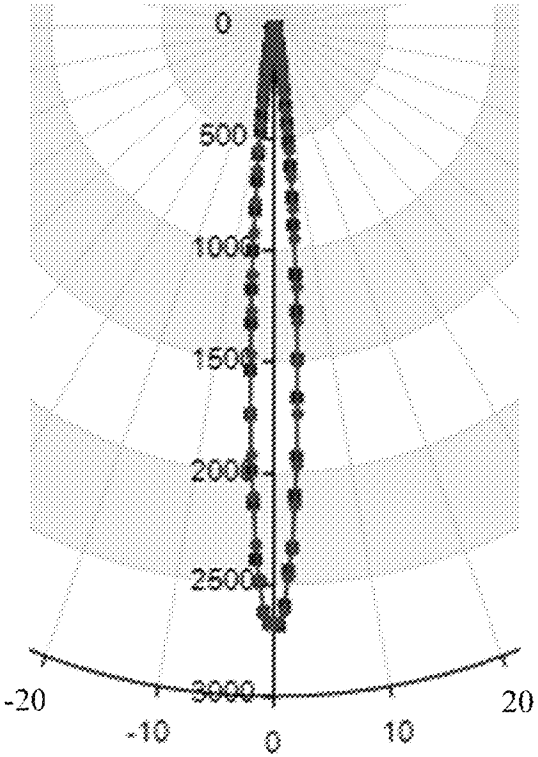
FIG. 4B PRIOR ART
FIGS. 4A and 4B are graphs illustrating simulations of a light distribution from the prior art lighting apparatus shown in FIG. 2 with additional light mixing.
Figure 4A:
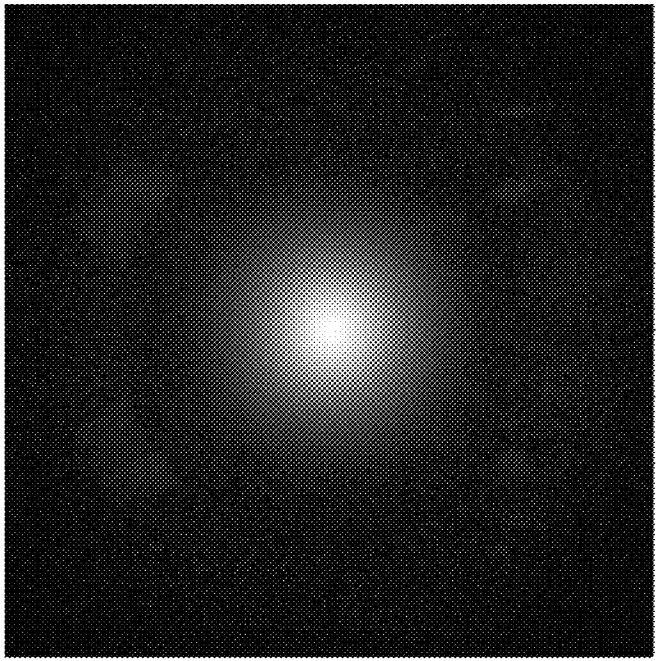
Figure 4A:
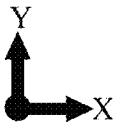

FIGS. 4A and 4B are graphs illustrating simulations of a light distribution from the prior art lighting apparatus shown in FIG. 2 with additional light mixing. Specifically, a first texture is provided to receive light from the light emitting surface of the first optic 215*a* and may function as a diffuser of the light. For example, the first texture may be a secondary optical component having a molded structure and/or an optical pattern that is arranged to receive light from the light emitting surface of the first optic 215*a*. Alternatively or in addition, the first texture may be incorporated within a film that is arranged on the light emitting surface of the first optic 215*a*, and/or molded directly into the light emitting surface of the first optic 215*a*. The amount of scattering may be adjusted by changing various properties of the first texture, such as the number of scratches or the depth and width of optical elements within the first texture. Similarly, a second texture is provided to receive light from the light emitting surface of the second optic 215*b* and may function as a diffuser of the light. For example, the second texture may be a secondary optical component having a molded structure and/or an optical pattern that is arranged to receive light from the light emitting surface of the second optic 215*b*. Alternatively or in addition, the second texture may be incorporated within a film that is arranged on the light emitting surface of the second optic 215*b*, and/or molded directly into the light emitting surface of the second optic 215*b*. The amount of scattering may be adjusted by changing various properties of the second texture, such as the number of scratches or the depth and width of optical elements within the second texture.

FIG. 4A shows a simulated true color plot 400 of the light distribution from the lighting apparatus with the first texture and the second texture on an 8' by 8' floor from a height of 10', and FIG. 4B shows a simulated polar intensity plot 405 of the light distribution from the lighting apparatus with the first texture and the second texture. In this example, the first light source 210*a* and the second light source 210*b* may provide equal light intensities. As shown in FIGS. 4A and 4B, the prior art lighting apparatus with the first texture and the second texture provides a tight light distribution that has a full-width at half-maximum (FWHM) of 8.8° in both the X direction and the Y direction. Although the first texture and the second texture provide a light distribution with improved uniformity, the light distribution is still warmer on the left-hand side and cooler on the right-hand side, due to the side-by-side arrangement of the first light fixture 200*a* and the second light fixture 200*b*. Further, at each extreme end of the CCT range that matches light from the first light source 210*a* or the second light source 210*b*, one of the light sources will be on and the other light source will be off, which limits the intensity of the light distribution and causes dark spots in the light distribution corresponding to the light source that is off.

Figure 5:
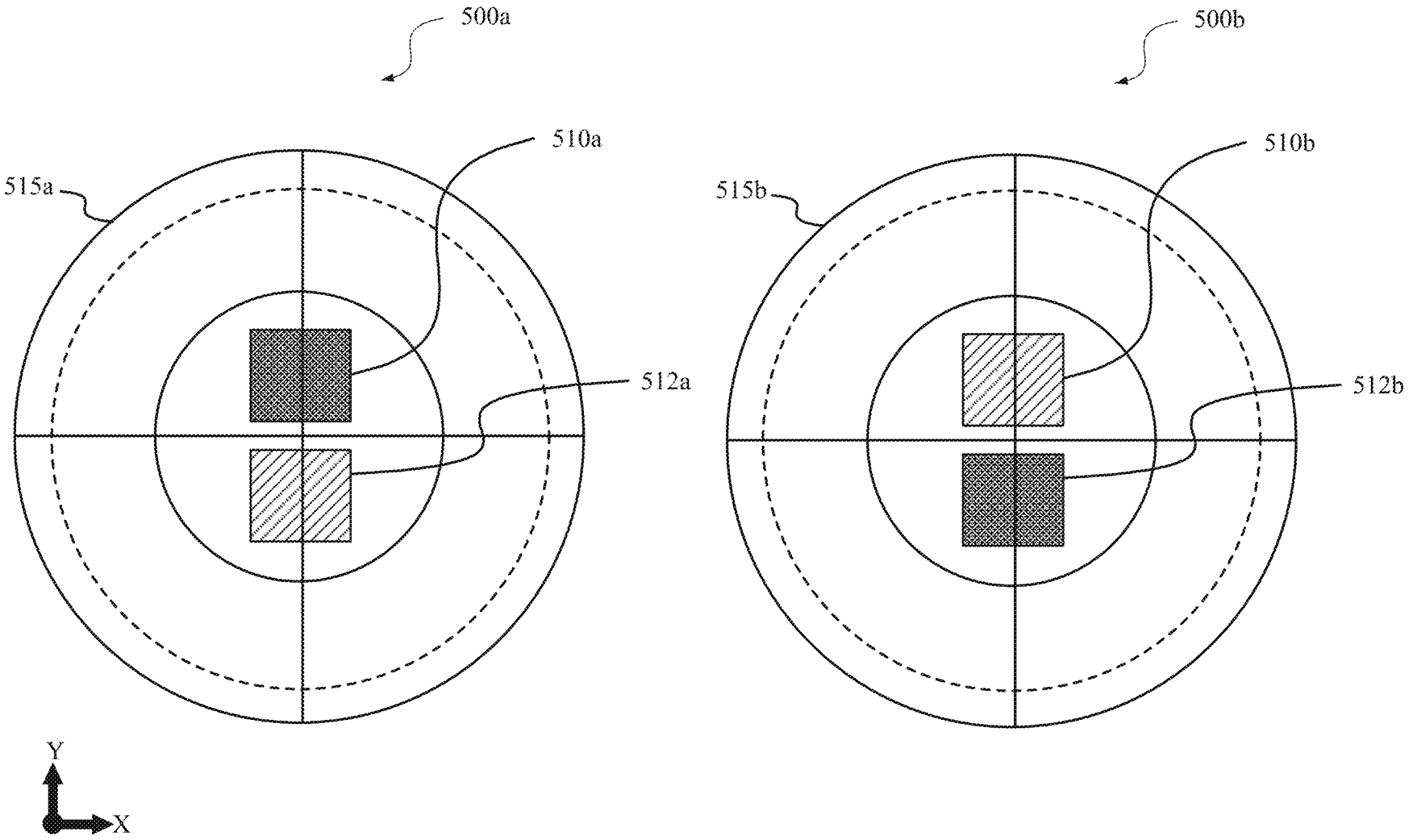
FIG. 5 is a schematic diagram of a lighting apparatus that may be used for white light tuning.

FIG. 5 is a schematic diagram of a lighting apparatus that may be used for white light tuning. The lighting apparatus may include a plurality of light fixtures, each of which includes a rotationally symmetric optic and a plurality of light sources that are arranged symmetrically about the optical axis. FIG. 5 shows a top view of the lighting apparatus. As shown in FIG. 5, the lighting apparatus may include a first light fixture 500*a* and a second light fixture 500*b*. The first light fixture 500*a* may include a first light source 510*a*, a second light source 512*a*, and a first optic 515*a*, each of which may be rotationally symmetric. The first light source 510*a* and the second light source 512*a* may be arranged at equal distances on opposite sides of the optical axis of the first optic 515*a*, such that a gap between the first light source 510*a* and the second light source 512*a* is centered with respect to the optical axis of the first optic 515*a*. The gap may be aligned with the focal point of the first optic 515*a*. For example, the gap may be positioned above, at, or below the focal point of the first optic 515*a*. Similarly, the second light fixture 500*b* may include a third light source 510*b*, a fourth light source 512*b*, and a second optic 515*b*, each of which may be rotationally symmetric. The third light source 510*b* and the fourth light source 512*b* may be arranged at equal distances on opposite sides of the optical axis of the second optic 515*b*, such that a gap between the third light source 510*b* and the fourth light source 512*b* is centered with respect to the optical axis of the second optic 515*b*. The gap may be aligned with the focal point of the second optic 515*b*. For example, the gap may be positioned above, at, or below the focal point of the second optic 515*b*.

The first light source 510*a* and the third light source 510*b* may be aligned along a first linear direction. The second light source 512*a* and the fourth light source 512*b* may be aligned along a second linear direction that is parallel to the first linear direction. The first light source 510*a* and the fourth light source 512*b* may have a first CCT, while the second light source 512*a* and the third light source 510*b* may have a second CCT. In this example, the first CCT may be 3000 K and the second CCT may be 6500 K. More generally, the first light source 510*a* and the fourth light source 512*b* may have a warmer hue that has a yellow appearance, while the second light source 512*a* and the third light source 510*b* may have a cooler hue that has a blue appearance. For example, the first CCT may be between 1800 K and 3500 K, and the second CCT may be between 4500 K and 7000 K. Light from the first light fixture 500*a* and light from the second light fixture 500*b* overlaps in the far field. The CCT of the resulting beam may be varied by adjusting the intensity of the first light source 510*a*, the second light source 512*a*, the third light source 510*b*, and/or the fourth light source 512*b*.

Figure 6B:
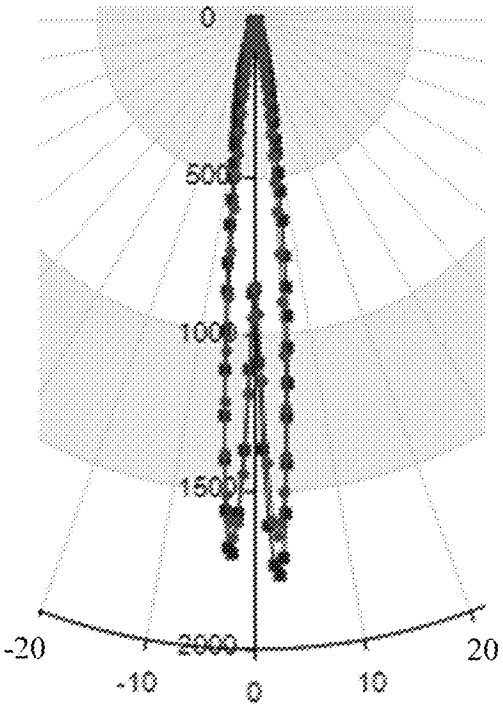
FIGS. 6A and 6B are graphs illustrating simulations of a light distribution from the lighting apparatus shown in FIG. 5.
Figure 6A:
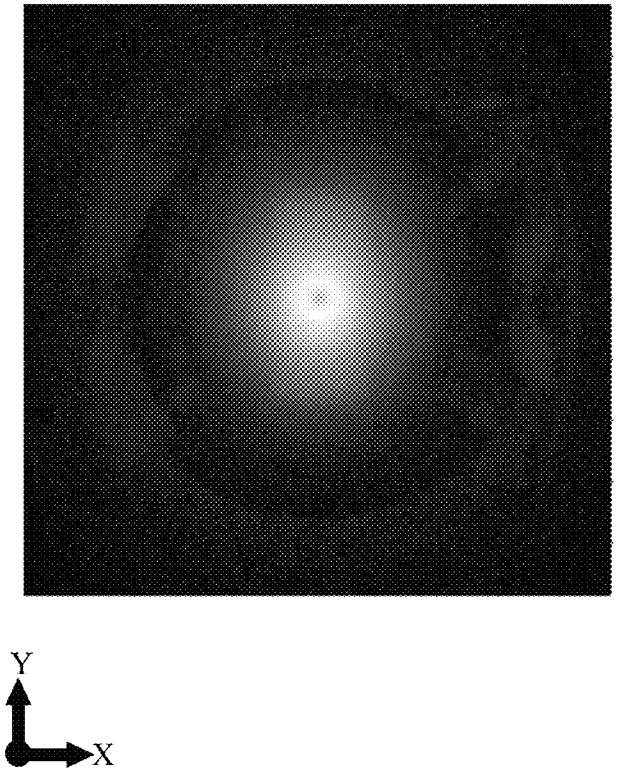

FIGS. 6A and 6B are graphs illustrating simulations of a light distribution from the lighting apparatus shown in FIG. 5. FIG. 6A shows a simulated true color plot 600 of the light distribution from the lighting apparatus on an 8' by 8' floor from a height of 10', and FIG. 6B shows a simulated polar intensity plot 605 of the light distribution from the lighting apparatus. As shown in FIGS. 6A and 6B, there is a gap in the middle of the light distribution, due to the gap that is formed between the first light source 510*a* and the second light source 512*a*, as well as the gap that is formed between the third light source 510*b* and the fourth light source 512*b*. The light distribution has a FWHM of 16.5° in the X direction and 17.8° in the Y direction. By using two light sources within each fixture, the intensity of the light distribution may be increased to be more similar to a static white fixture that uses only a single set of light of sources with one of the two CCTs. This may also result in a fixture that does not have any dark spots throughout the entire CCT range.

Figure 7B:
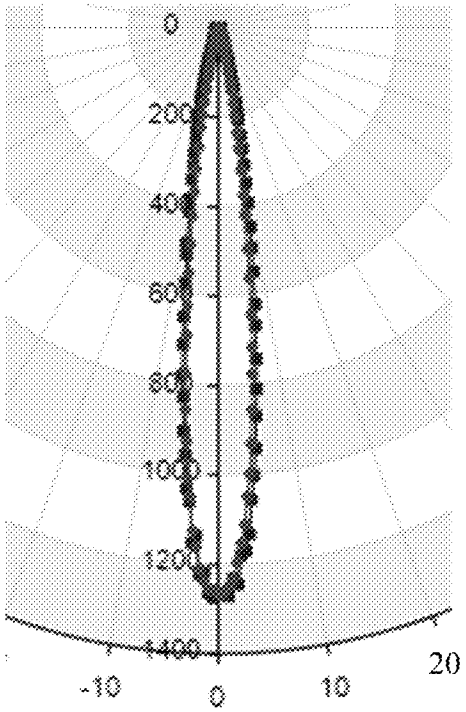
FIGS. 7A and 7B are graphs illustrating simulations of a light distribution from the lighting apparatus shown in FIG. 5 with additional light mixing.
Figure 7A:
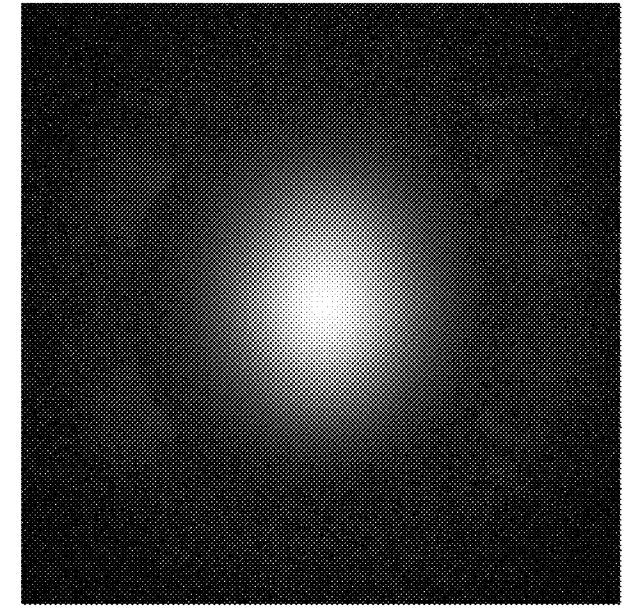

FIGS. 7A and 7B are graphs illustrating simulations of a light distribution from the lighting apparatus shown in FIG. 5 with additional light mixing. Specifically, a first texture is provided to receive light from the light emitting surface of the first optic 515*a* and may function as a diffuser of the light. For example, the first texture may be a secondary optical component having a molded structure and/or an optical pattern that is arranged to receive light from the light emitting surface of the first optic 515*a*. Alternatively or in addition, the first texture may be incorporated within a film that is arranged on the light emitting surface of the first optic 515*a*, and/or molded directly into the light emitting surface of the first optic 515*a*. The amount of scattering may be adjusted by changing various properties of the first texture, such as the number of scratches or the depth and width of optical elements within the first texture. Similarly, a second texture is provided to receive light from the light emitting surface of the second optic 515*b* and may function as a diffuser of the light. For example, the second texture may be a secondary optical component having a molded structure and/or an optical pattern that is arranged to receive light from the light emitting surface of the second optic 515*b*. Alternatively or in addition, the second texture may be incorporated within a film that is arranged on the light emitting surface of the second optic 515*b*, and/or molded directly into the light emitting surface of the second optic 515*b*. The amount of scattering may be adjusted by changing various properties of the second texture, such as the number of scratches or the depth and width of optical elements within the second texture.

FIG. 7A shows a simulated true color plot 700 of the light distribution from the lighting apparatus with the first texture and the second texture on an 8' by 8' floor from a height of 10', and FIG. 7B shows a simulated polar intensity plot 705 of the light distribution from the lighting apparatus with the first texture and the second texture. As shown in FIGS. 7A and 7B, the lighting apparatus with the first texture and the second texture provides a slightly oblong light distribution that has a FWHM of 13.7° in the X direction and 14.5° in the Y direction. This light distribution is more oblong and wider as compared with the light distribution produced by the lighting apparatus 100 shown in FIG. 1.

Figure 8:
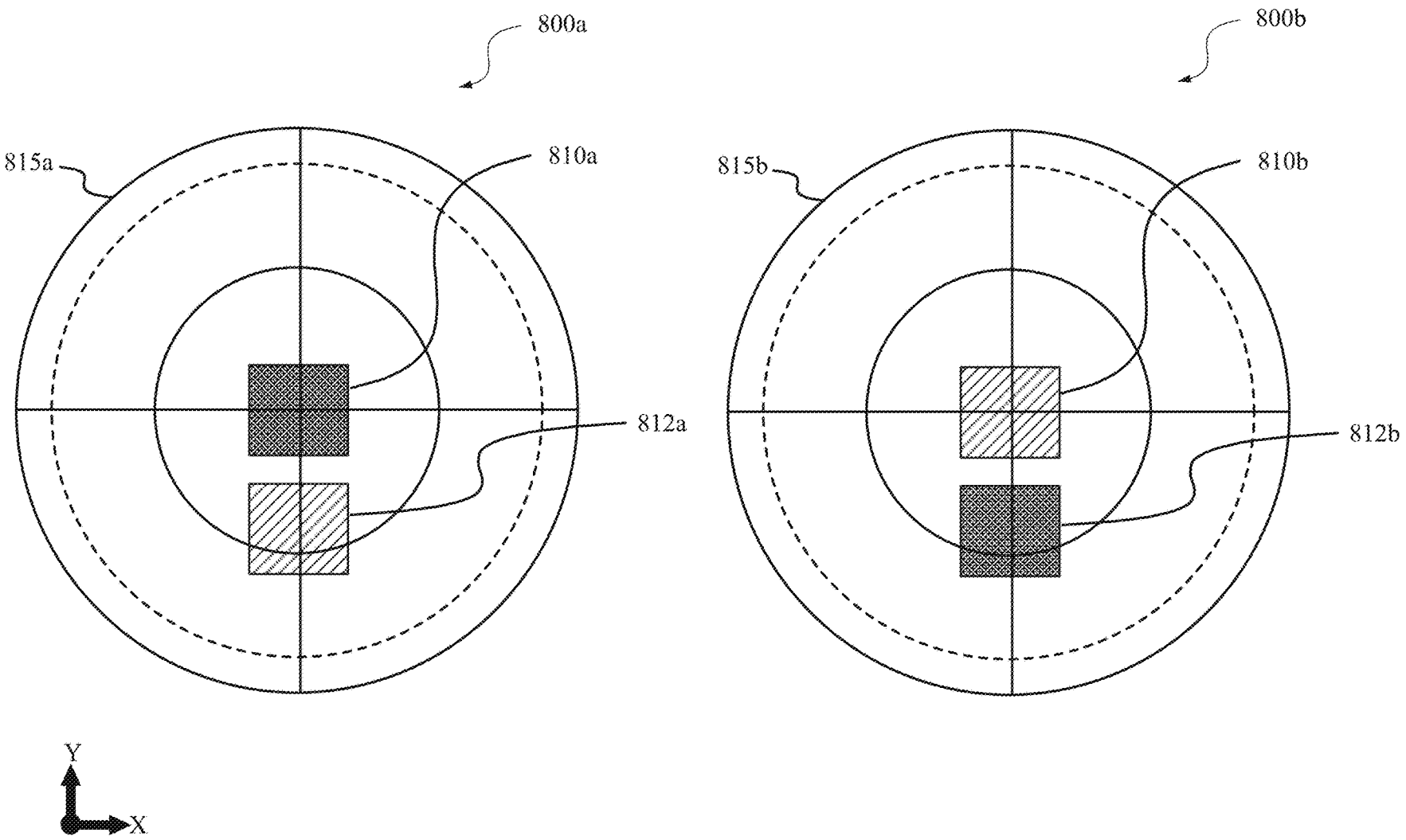
FIG. 8 is a schematic diagram of another lighting apparatus that may be used for white light tuning.

FIG. 8 is a schematic diagram of a lighting apparatus that may be used for white light tuning. The lighting apparatus may include a light fixture having a rotationally symmetric optic and a plurality of light sources. One of the light sources is centered with respect to the optic, and at least another one of the light sources is off-center with respect to the optic. The lighting apparatus may also include additional light fixtures having similar components, as discussed in further detail below.

FIG. 8 shows a top view of the lighting apparatus. As shown in FIG. 8, the lighting apparatus may include a first light fixture 800*a* and a second light fixture 800*b*. The first light fixture 800*a* may include a first light source 810*a*, a second light source 812*a*, and a first optic 815*a*, each of which may be rotationally symmetric. The first light source 810*a* may be arranged at a position that is centered with respect to a first optical axis of the first optic 815*a*. The first light source 810*a* may be arranged above, at, or below the focal point of the first optic 815*a*. The second light source 812*a* may be arranged at a position that is off-center with respect to the first optical axis of the first optic 815*a*. The first light source 810*a* and the second light source 812*a* may be arranged in the same plane. Similarly, the second light fixture 800*b* may include a third light source 810*b*, a fourth light source 812*b*, and a second optic 815*b*, each of which may be rotationally symmetric. The third light source 810*b* may be arranged at a position that is centered with respect to a second optical axis of the second optic 815*b*. The third light source 810*b* may be arranged above, at, or below the focal point of the second optic 815*b*. The fourth light source 812*b* may be arranged at a position that is off-center with respect to the second optical axis of second optic 815*b*. The third light source 810*b* and the fourth light source 812*b* may be arranged in the same plane.

The first light source 810*a* and the third light source 810*b* may be aligned along a first linear direction. The second light source 812*a* and the fourth light source 812*b* may be aligned along a second linear direction that is parallel to the first linear direction. The first light source 810*a* and the fourth light source 812*b* may have a first CCT, while the second light source 812*a* and the third light source 810*b* may have a second CCT. In this example, the first CCT may be 3000 K and the second CCT may be 6500 K. More generally, the first light source 810*a* and the fourth light source 812*b* may have a warmer hue that has a yellow appearance, while the second light source 812*a* and the third light source 810*b* may have a cooler hue that has a blue appearance. For example, the first CCT may be between 1800 K and 3500 K, and the second CCT may be between 4500 K and 7000 K. Light from the first light fixture 800*a* and light from the second light fixture 800*b* overlaps in the far field. The CCT of the resulting beam may be varied by adjusting the intensity of the first light source 810*a*, the second light source 812*a*, the third light source 810*b*, and/or the fourth light source 812*b*.

Figure 9B:
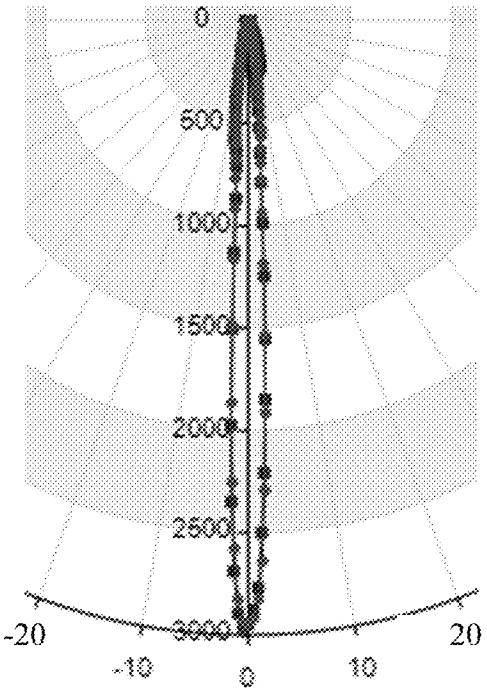
FIGS. 9A and 9B are graphs illustrating simulations of a light distribution from the lighting apparatus shown in FIG. 8.
Figure 9A:
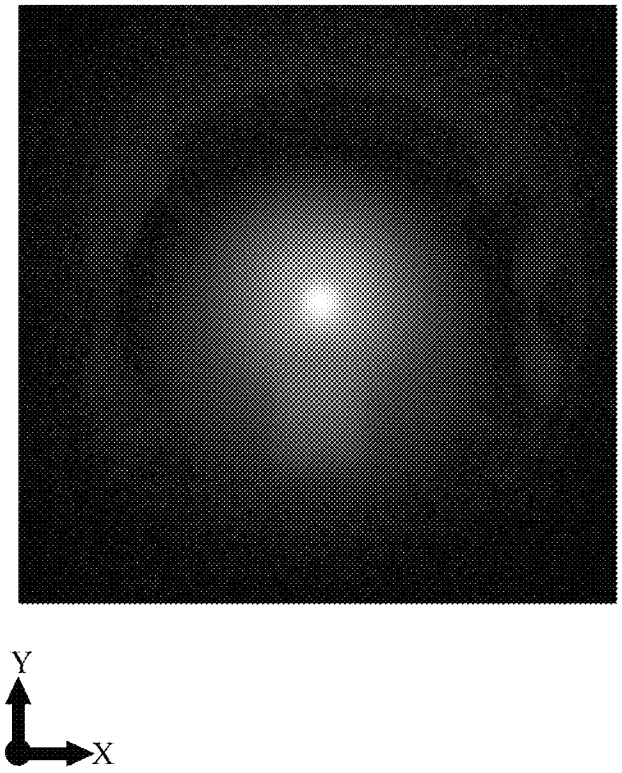

FIGS. 9A and 9B are graphs illustrating simulations of a light distribution from the lighting apparatus shown in FIG. 8. FIG. 9A shows a simulated true color plot 900 of the light distribution from the lighting apparatus on an 8' by 8' floor from a height of 10', and FIG. 9B shows a simulated polar intensity plot 905 of the light distribution from the lighting apparatus. As shown in FIGS. 9A and 9B, an image of the second light source 812*a* and the fourth light source 812*b* is visible, due to the placement of these light sources at positions that are out of focus with respect to their respective optics. However, the characteristics of the light distribution are dominated by the first light source 810*a* and the third light source 810*b*, which are centered with respect to their respective optics. The light distribution has a FWHM of 6.1° in the X direction and the Y direction. The beam tightness and color mixing are improved as compared with the lighting apparatus shown in FIG. 5.

Figure 10B:
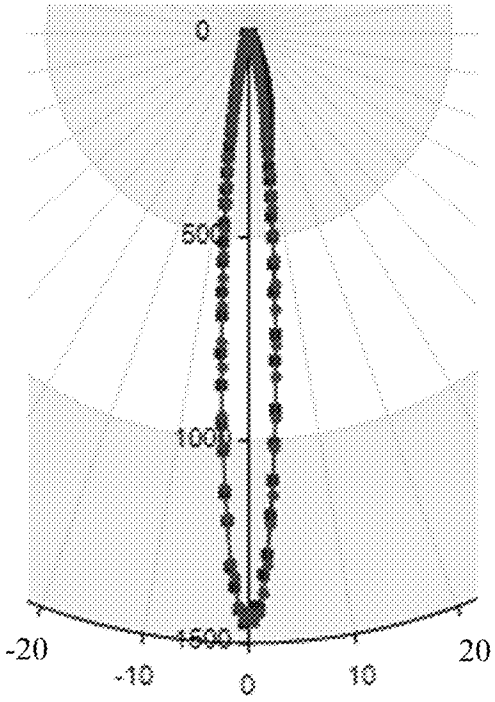
FIGS. 10A and 10B are graphs illustrating simulations of a light distribution from the lighting apparatus shown in FIG. 8 with additional light mixing.
Figure 10A:
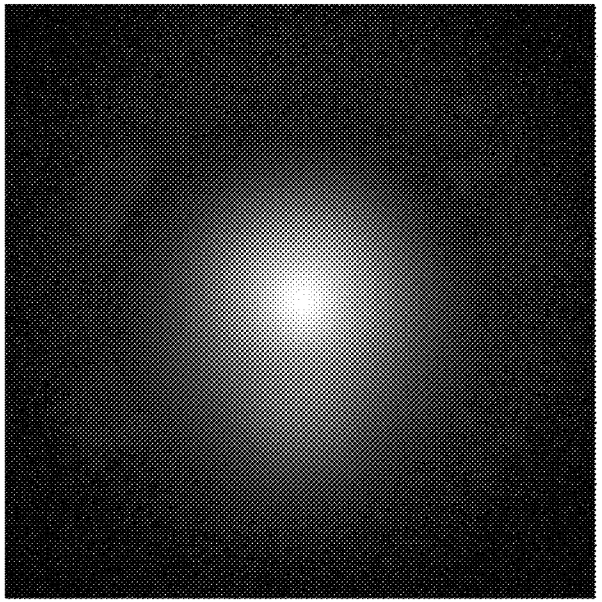
Figure 10A:
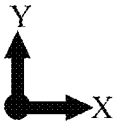

FIGS. 10A and 10B are graphs illustrating simulations of a light distribution from the lighting apparatus shown in FIG. 8 with additional light mixing. Specifically, a first texture is provided to receive light from the light emitting surface of the first optic 815*a* and may function as a diffuser of the light. For example, the first texture may be a secondary optical component having a molded structure and/or an optical pattern that is arranged to receive light from the light emitting surface of the first optic 815*a*. Alternatively or in addition, the first texture may be incorporated within a film that is arranged on the light emitting surface of the first optic 815*a*, and/or molded directly into the light emitting surface of the first optic 815*a*. The amount of scattering may be adjusted by changing various properties of the first texture, such as the number of scratches or the depth and width of optical elements within the first texture. Similarly, a second texture is provided to receive light from the light emitting surface of the second optic 815*b* and may function as a diffuser of the light. For example, the second texture may be a secondary optical component having a molded structure and/or an optical pattern that is arranged to receive light from the light emitting surface of the second optic 815*b*. Alternatively or in addition, the second texture may be incorporated within a film that is arranged on the light emitting surface of the second optic 815*b*, and/or molded directly into the light emitting surface of the second optic 815*b*. The amount of scattering may be adjusted by changing various properties of the second texture, such as the number of scratches or the depth and width of optical elements within the second texture.

FIG. 10A shows a simulated true color plot 1000 of the light distribution from the lighting apparatus with the first texture and the second texture on an 8' by 8' floor from a height of 10', and FIG. 10B shows a simulated polar intensity plot 1005 of the light distribution from the lighting apparatus with the first texture and the second texture. As shown in FIGS. 10A and 10B, the lighting apparatus with the first texture and the second texture provides a light distribution that has a FWHM of 10.6° in the X direction and the Y direction. A blurred image of the second light source 812*a* and the fourth light source 812*b* may be visible. However, this blurred image could be reduced or eliminated by using a heavier first texture and/or second texture to further smooth out the light distribution. Alternatively or in addition, more light fixtures may be added with the positions of the light sources selected to provide a more symmetric light distribution. For example, pairs of light fixtures having light sources in different quadrants may be combined to improve the symmetry of the light distribution.

Figure 11:
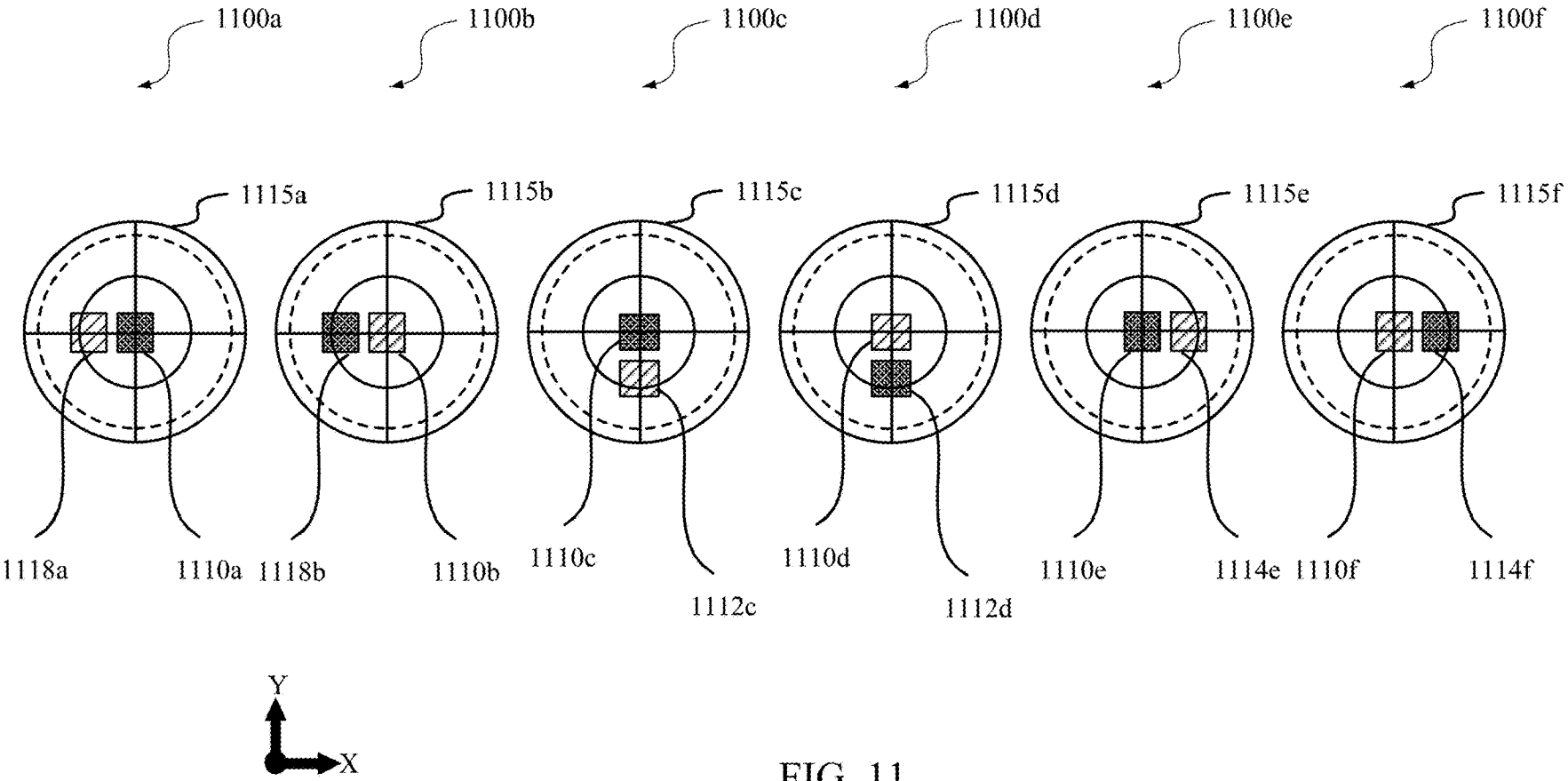
FIG. 11 is a schematic diagram of yet another lighting apparatus that may be used for white light tuning.

FIG. 11 is a schematic diagram of a lighting apparatus that may be used for white light tuning. The lighting apparatus may include a plurality of light fixtures that occur in pairs. For example, each light fixture may include a rotationally symmetric optic and two light sources. Within each light fixture, one of the light sources is centered with respect to the optic, and the other one of the light sources is off-center with respect to the optic. Within each pair of light fixtures, the light sources that are off-center with respect to the optic may be arranged at the same position with respect to the light source that is centered with respect to the optic. For example, each of the light sources that are off-center with respect to the optic may be positioned to the east of the respective light source that is centered with respect to the optic. This pattern may rotate to provide a more symmetric light distribution. Further, within each pair of light fixtures, the CCTs of the light sources may be reversed.

FIG. 11 shows a top view of the lighting apparatus. As shown in FIG. 11, the lighting apparatus may include a first light fixture 1100*a*, a second light fixture 1100*b*, a third light fixture 1100*c*, a fourth light fixture 1100*d*, a fifth light fixture 1100*e*, and a sixth light fixture 1100*f*. Although six light fixtures are shown in FIG. 11, more or fewer light fixtures may be included. The first light fixture 1100*a* and the second light fixture 1100*b* may form a first pair. The first light fixture 1100*a* may include a first light source 1110*a*, a second light source 1118*a*, and a first optic 1115*a*, each of which may be rotationally symmetric. The first light source 1110*a* may be arranged at a position that is centered with respect to a first optical axis of the first optic 1115*a*, and the second light source 1118*a* may be arranged at a position that is off-center with respect to the first optical axis of the first optic 1115*a*. Similarly, the second light fixture 1100*b* may include a third light source 1110*b*, a fourth light source 1118*b*, and a second optic 1115*b*, each of which may be rotationally symmetric. The third light source 1110*b* may be arranged at a position that is centered with respect to a second optical axis of the second optic 1115*b*, and the fourth light source 1118*b* may be arranged at a position that is off-center with respect to the second optical axis of the second optic 1115*b*. The second light source 1118*a* may be arranged on the west side of the first light source 1110*a*, and the fourth light source 1118*b* may be arranged on the west side of the third light source 1110*b*. The first light source 1110*a* and the fourth light source 1118*b* may have a first CCT, while the second light source 1118*a* and the third light source 1110*b* may have a second CCT.

Further, the third light fixture 1100*c* and the fourth light fixture 1100*d* may form a second pair. The third light fixture 1100*c* may include a fifth light source 1110*c*, a sixth light source 1112*c*, and a third optic 1115*c*, each of which may be rotationally symmetric. The fifth light source 1110*c* may be arranged at a position that is centered with respect to a third optical axis of the third optic 1115*c*, and the sixth light source 1112*c* may be arranged at a position that is off-center with respect to the third optical axis of the third optic 1115*c*. Similarly, the fourth light fixture 1100*d* may include a seventh light source 1110*d*, an eighth light source 1112*d*, and a fourth optic 1115*d*, each of which may be rotationally symmetric. The seventh light source 1110*d* may be arranged at a position that is centered with respect to a fourth optical axis of the fourth optic 1115*d*, and the eighth light source 1112*d* may be arranged at a position that is off-center with respect to the fourth optical axis of the fourth optic 1115*d*. The sixth light source 1112*c* may be arranged on the south side of the fifth light source 1110*c*, and the eighth light source 1112*d* may be arranged on the south side of the seventh light source 1110*d*. The fifth light source 1110*c* and the eighth light source 1112*d* may have the first CCT, while the sixth light source 1112*c* and the seventh light source 1110*d* may have the second CCT.

In addition, the fifth light fixture 1100*e* and the sixth light fixture 1100*f* may form a third pair. The fifth light fixture 1100*e* may include a ninth light source 1110*e*, a tenth light source 1114*e*, and a fifth optic 1115*e*, each of which may be rotationally symmetric. The ninth light source 1110*e* may be arranged at a position that is centered with respect to a fifth optical axis of the fifth optic 1115*e*, and the tenth light source 1114*e* may be arranged at a position that is off-center with respect to the fifth optical axis of the fifth optic 1115*e*. Similarly, the sixth light fixture 1100*f* may include an eleventh light source 1110*f*, a twelfth light source 1114*f*, and a sixth optic 1115*f*, each of which may be rotationally symmetric. The eleventh light source 1110*f* may be arranged a position that is centered with respect to a sixth optical axis of the sixth optic 1115*f*, and the twelfth light source 1114*f* may be arranged at a position that is off-center with respect to the sixth optical axis of the sixth optic 1115*f*. The tenth light source 1114*e* may be arranged on the east side of the ninth light source 1110*e*, and the twelfth light source 1114*f* may be arranged on the east side of the eleventh light source 1110*f*. The ninth light source 1110*e* and the twelfth light source 1114*f* may have the first CCT, while the tenth light source 1114*e* and the eleventh light source 1110*f* may have the second CCT.

The second light source 1118*a*, the first light source 1110*a*, the fourth light source 1118*b*, the third light source 1110*b*, the fifth light source 1110*c*, the seventh light source 1110*d*, the ninth light source 1110*e*, the tenth light source 1114*e*, the eleventh light source 1110*f*, and the twelfth light source 1114*f* may be arranged in order along a first linear direction (e.g., the X direction shown in FIG. 11). The sixth light source 1112*c* and the eighth light source 1112*d* may be arranged in order along a second linear direction that is parallel to the first linear direction. The fifth light source 1110*c* and the sixth light source may be arranged in order along a third linear direction (e.g., the Y direction shown in FIG. 11) that is perpendicular to the first linear direction. The seventh light source 1110*d* and the eighth light source may be arranged in order along a fourth linear direction that is parallel to the third linear direction and perpendicular to the first linear direction.

Figure 12:
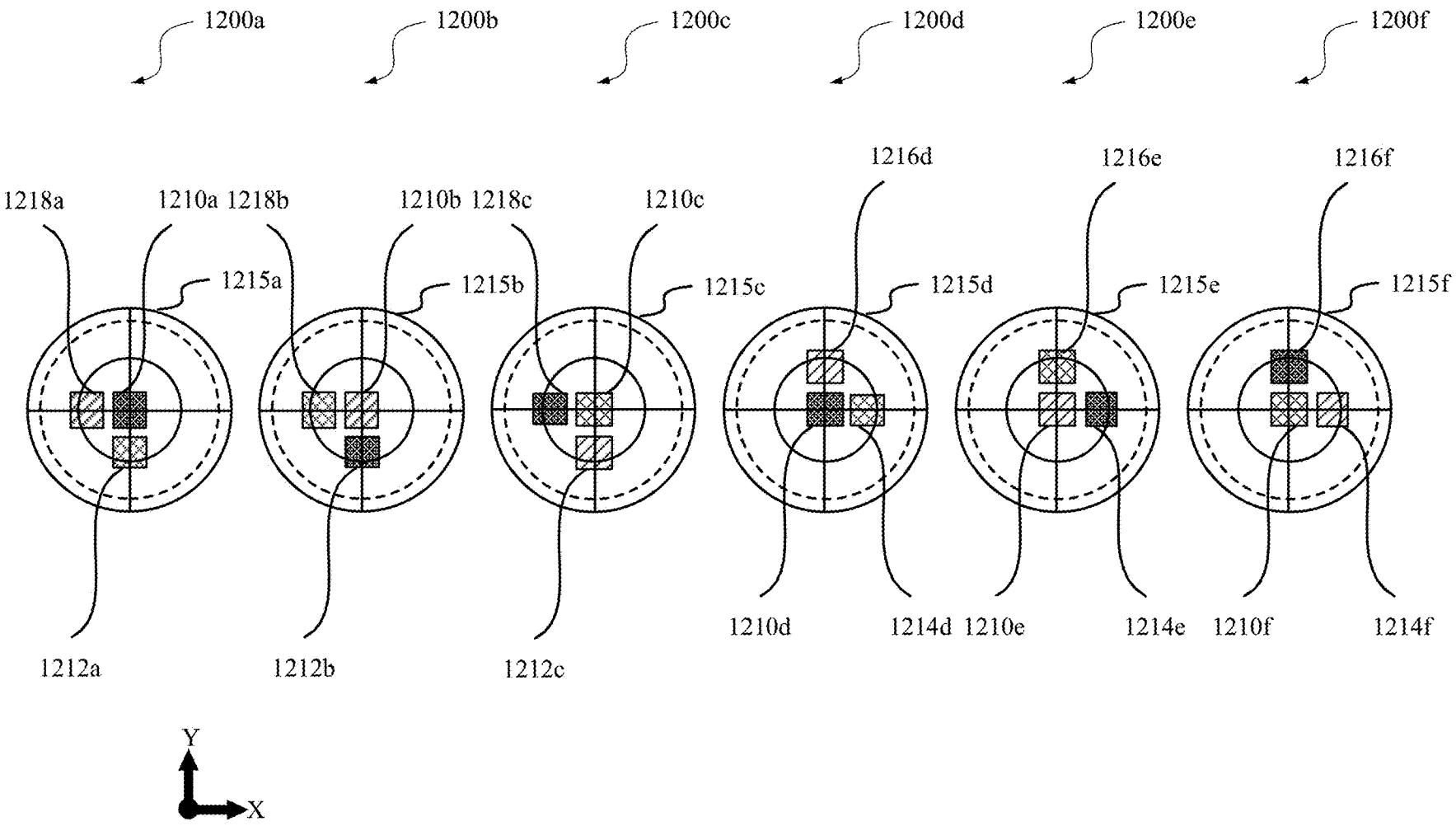
FIG. 12 is a schematic diagram of still another lighting apparatus that may be used for white light tuning.

FIG. 12 is a schematic diagram of a lighting apparatus that may be used for white light tuning. The lighting apparatus may include a plurality of light fixtures that occur in triplets. For example, each light fixture may include a rotationally symmetric optic and three light sources. Within each of the light fixtures, one of the light sources is centered with respect to the optic, and the other two the light sources are off-center with respect to the optic. Within each triplet of light fixtures, the light sources that are off-center with respect to the optic may be arranged at the same positions with respect to the light source that is centered with respect to the optic. For example, one of the light sources that is off-center with respect to the optic may be positioned to the west of the respective light source that is centered with respect to the optic, and the other one of the light sources that is off-center with respect to the optic may be positioned to the south of the respective light source that is centered with respect to the optic. This pattern may rotate to provide a more symmetric light distribution. Further, within each triplet of light fixtures, the CCTs of the light sources may rotate by 90 degree increments through the positions of the light sources.

FIG. 12 shows a top view of the lighting apparatus. As shown in FIG. 12, the lighting apparatus may include a first light fixture 1200*a*, a second light fixture 1200*b*, a third light fixture 1200*c*, a fourth light fixture 1200*d*, a fifth light fixture 1200*e*, and a sixth light fixture 1200*f*. Although six light fixtures are shown in FIG. 12, more or fewer light fixtures may be included. The first light fixture 1200*a*, the second light fixture 1200*b*, and the third light fixture 1200*c* may form a first triplet. The first light fixture 1200*a* may include a first light source 1210*a*, a second light source 1218*a*, a third light source 1212*a*, and a first optic 1215*a*, each of which may be rotationally symmetric. The first light source 1210*a* may be arranged at a position that is centered with respect to a first optical axis of the first optic 1215*a*, and the second light source 1218*a* and the third light source 1212*a* may be arranged at positions that are off-center with respect to the first optical axis of the first optic 1215*a*. Similarly, the second light fixture 1200*b* may include a fourth light source 1210*b*, a fifth light source 1218*b*, a sixth light source 1212*b*, and a second optic 1215*b*, each of which may be rotationally symmetric. The fourth light source 1210*b* may be arranged at a position that is centered with respect to a second optical axis of the second optic 1215*b*, and the fifth light source 1218*b* and the sixth light source 1212*b* may be arranged at positions that are off-center with respect to the second optical axis of the second optic 1215*b*. Further, the third light fixture 1200*c* may include a seventh light source 1210*c*, an eighth light source 1218*c*, a ninth light source 1212*c*, and a third optic 1215*c*, each of which may be rotationally symmetric. The seventh light source 1210*c* may be arranged at a position that is centered with respect to a third optical axis of the third optic 1215*c*, and the eighth light source 1218*c* and the ninth light source 1212*c* may be arranged at positions that are off-center with respect to the third optical axis of the third optic 1215*c*.

The second light source 1218*a* may be arranged on the west side of the first light source 1210*a*, the fifth light source 1218*b* may be arranged on the west side of the fourth light source 1210*b*, and the eighth light source 1218*c* may be arranged on the west side of the seventh light source 1210*c*.

The third light source 1212*a* may be arranged on the south side of the first light source 1210*a*, the sixth light source 1212*b* may be arranged on the south side of the fourth light source 1210*b*, and the ninth light source 1212*c* may be arranged on the south side of the seventh light source 1210*c*. The first light source 1210*a*, the sixth light source 1212*b*, and the eighth light source 1218*c* may have a first CCT. The second light source 1218*a*, the fourth light source 1210*b*, and the ninth light source 1212*c* may have a second CCT. The third light source 1212*a*, the fifth light source 1218*b*, and the seventh light source 1210*c* may have a third CCT.

The fourth light fixture 1200*d*, the fifth light fixture 1200*e*, and the sixth light fixture 1200*f* may form a second triplet. The fourth light fixture 1200*d* may include a tenth light source 1210*d*, an eleventh light source 1216*d*, a twelfth light source 1214*d*, and a fourth optic 1215*d*, each of which may be rotationally symmetric. The tenth light source 1210*d* may be arranged at a position that is centered with respect to a fourth optical axis of the fourth optic 1215*d*, and the eleventh light source 1216*d* and the twelfth light source 1214*d* may be arranged at positions that are off-center with respect to the fourth optical axis of the fourth optic 1215*d*. Similarly, the fifth light fixture 1200*e* may include a thirteenth light source 1210*e*, a fourteenth light source 1216*e*, a fifteenth light source 1214*e*, and a fifth optic 1215*e*, each of which may be rotationally symmetric. The thirteenth light source 1210*e* may be arranged a position that is centered with respect to a fifth optical axis of the fifth optic 1215*e*, and the fourteenth light source 1216*e* and the fifteenth light source 1214*e* may be arranged at positions that are off-center with respect to the fifth optical axis of the fifth optic 1215*e*. Further, the sixth light fixture 1200*f* may include a sixteenth light source 1210*f*, a seventeenth light source 1216*f*, an eighteenth light source 1214*f*, and a sixth optic 1215*f*, each of which may be rotationally symmetric. The sixteenth light source 1210*f* may be arranged a position that is centered with respect to a sixth optical axis of the sixth optic 1215*f*, and the seventeenth light source 1216*f* and the eighteenth light source 1214*f* may be arranged at positions that are off-center with respect to the sixth optical axis of the sixth optic 1215*f*.

The eleventh light source 1216*d* may be arranged on the north side of the tenth light source 1210*d*, the fourteenth light source 1216*e* may be arranged on the north side of the thirteenth light source 1210*e*, and the seventeenth light source 1216*f* may be arranged on the north side of the sixteenth light source 1210*f*. The twelfth light source 1214*d* may be arranged on the east side of the tenth light source 1210*d*, the fifteenth light source 1214*e* may be arranged on the east side of the thirteenth light source 1210*e*, and the eighteenth light source 1214*f* may be arranged on the east side of the sixteenth light source 1210*f* The thirteenth light source 1210*e*, fifteenth light source 1214*e*, and the seventeenth light source 1216*f* may have the first CCT. The eleventh light source 1216*d*, the thirteenth light source 1210*e*, and the eighteenth light source 1214*f* may have the second CCT. The twelfth light source 1214*d*, the fourteenth light source 1216*e*, and the sixteenth light source 1210*f* may have the third CCT.

In some examples, the first CCT may be 2700 K, the second CCT may be 5000 K, and the third CCT may be 6500 K. This may provide a wider range of CCTs than the examples discussed above with two CCTs. More generally, the first CCT may be between 1800 K and 3500 K, the second CCT may be between 4500 K and 5500 K, and third CCT may be between 5600 K and 7000 K.

In other examples, instead of being configured to emit light having a CCT, the light sources may be configured to emit light having a specific wavelength. For example, with reference to the first triplet, the first light source 1210*a*, the sixth light source 1212*b*, and the eighth light source 1218*c* may be configured to emit light having a first wavelength. The second light source 1218*a*, the fourth light source 1210*b*, and the ninth light source 1212*c* may be configured to emit light having a second wavelength. The third light source 1212*a*, the fifth light source 1218*b*, and the seventh light source 1210*c* may be configured to emit light having a third wavelength. The first wavelength may be within the red portion of the electromagnetic spectrum, such as between 635 nm and 700 nm. The second wavelength may be within the green portion of the electromagnetic spectrum, such as between 520 nm and 560 nm. The third wavelength may be within the blue portion of the electromagnetic spectrum, such as between 450 nm and 490 nm. Alternatively, the light sources may be configured to emit full spectrum desaturated light having white points away from the blackbody and producing reddish, greenish, and blueish white light. This configuration may produce higher lumen levels with higher quality white light that is always on the blackbody.

In other examples, some or all of the light sources may be configured to emit light having different characteristics. For example, a lighting apparatus for circadian rhythms may use at least one light source having a CCT of 3000 K. In contrast, a lighting apparatus for alertness may use at least one light source having a CCT of 5000 K. To prevent awakening, one light source may have a CCT of 1800 K. The user may control the light output by choosing one of the channels. To provide animal-safe lighting, at least one light source may emit amber light. To provide the ability to sanitize an area, at least one light source may emit ultraviolet light.

Figure 13:
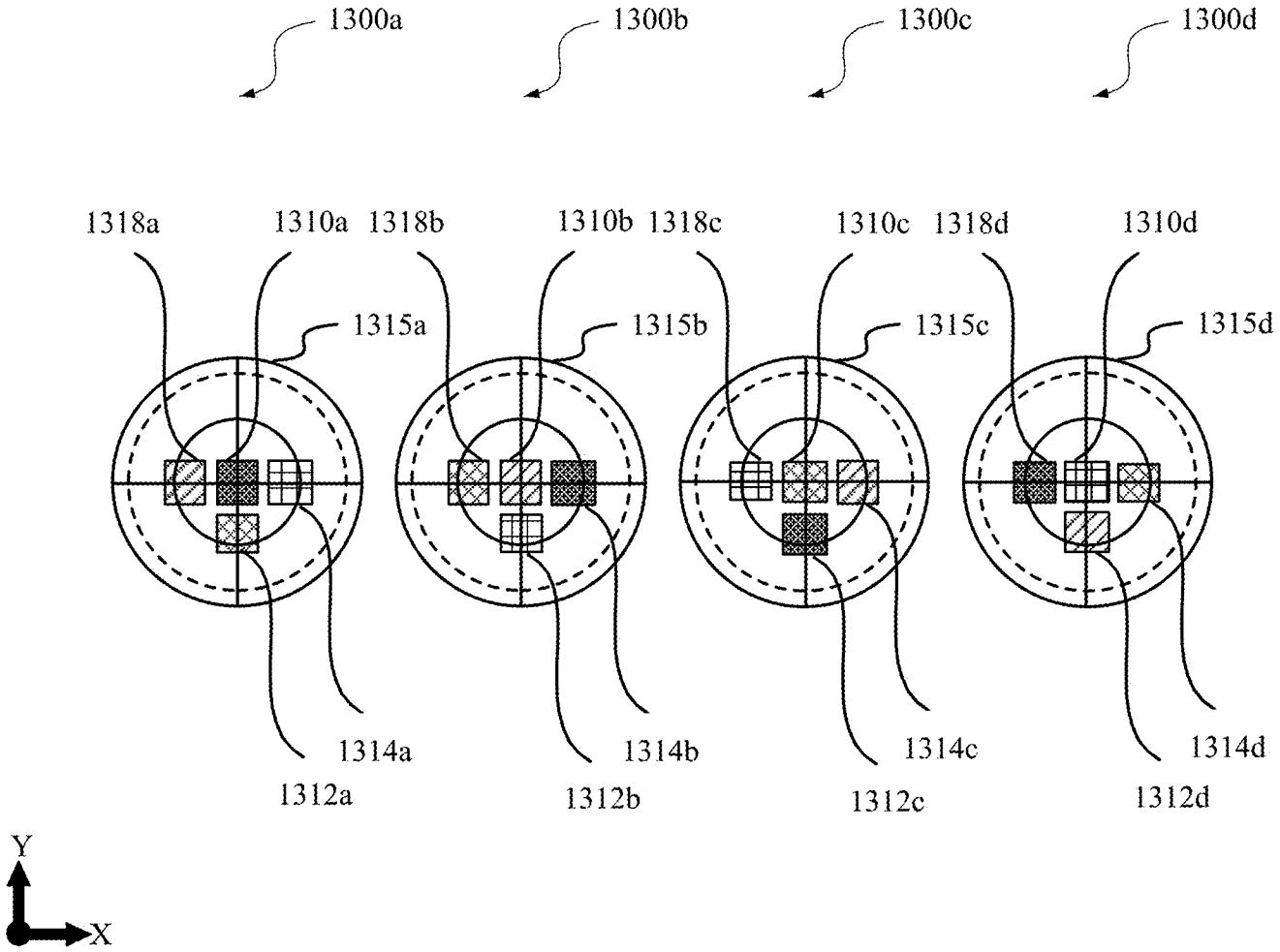
FIG. 13 is a schematic diagram of yet another lighting apparatus that may be used for white light tuning.

FIG. 13 is a schematic diagram of a lighting apparatus that may be used for white light tuning. The lighting apparatus may include a plurality of light fixtures that occur in quadruplets. For example, each light fixture may include a rotationally symmetric optic and four light sources. Within each of the light fixtures, one of the light sources is centered with respect to the optic, and the other three light sources are off-center with respect to the optic. Within each quadruplet of light fixtures, the light sources that are off-center with respect to the optic may be arranged at the same position with respect to the light source that is centered with respect to the optic. For example, one of the light sources that is off-center with respect to the optic may be positioned to the west of the respective light source that is centered with respect to the optic, another one of the light sources that is off-center with respect to the optic may be positioned to the south of the respective light source that is centered with respect to the optic, and the other one of the light sources that is off-center with respect to the optic may be positioned to the east of the respective light source that is centered with respect to the optic. This pattern may rotate to provide a more symmetric light distribution. Further, within each quadruplet of light fixtures, the CCTs of the light sources may rotate by 90 degree increments through the positions of the light sources.

FIG. 13 shows a top view of the lighting apparatus. As shown in FIG. 13, the lighting apparatus may include a first light fixture 1300*a*, a second light fixture 1300*b*, a third light fixture 1300*c*, and a fourth light fixture 1300*d*. Although four light fixtures are shown in FIG. 13, more or fewer light fixtures may be included. The first light fixture 1300*a*, the second light fixture 1300*b*, the third light fixture 1300*c*, and the fourth light fixture 1300*d* may form a quadruplet. The first light fixture 1300*a* may include a first light source 1310*a*, a second light source 1318*a*, a third light source 1312*a*, a fourth light source 1314*a*, and a first optic 1315*a*, each of which may be rotationally symmetric. The first light source 1310*a* may be arranged at a position that is centered with respect to a first optical axis of the first optic 1315*a*, and the second light source 1318*a*, the third light source 1312*a*, and the fourth light source 1314*a* may be arranged at positions that are off-center with respect to the first optical axis of the first optic 1315*a*. Similarly, the second light fixture 1300*b* may include a fifth light source 1310*b*, a sixth light source 1318*b*, a seventh light source 1312*b*, an eighth light source 1314*b*, and a second optic 1315*b*, each of which may be rotationally symmetric. The fifth light source 1310*b* may be arranged at a position that is centered with respect to a second optical axis of the second optic 1315*b*, and the sixth light source 1318*b*, the seventh light source 1312*b*, and the eighth light source 1314*b* may be arranged at positions that are off-center with respect to the second optical axis of the second optic 1315*b*. Further, the third light fixture 1300*c* may include a ninth light source 1310*c*, a tenth light source 1318*c*, an eleventh light source 1312*c*, a twelfth light source 1314*c*, and a third optic 1315*c*, each of which may be rotationally symmetric. The ninth light source 1310*c* may be arranged at a position that is centered with respect to a third optical axis of the third optic 1315*c*, and the tenth light source 1318*c*, eleventh light source 1312*c*, and twelfth light source 1314*c* may be arranged at positions that are off-center with respect to the third optical axis of the third optic 1315*c*. In addition, the fourth light fixture 1300*d* may include a thirteenth light source 1310*d*, a fourteenth light source 1318*d*, a fifteenth light source 1312*d*, a sixteenth light source 1314*d*, and a fourth optic 1315*d*, each of which may be rotationally symmetric. The thirteenth light source 1310*d* may be arranged at a position that is centered with respect to a fourth optical axis of the fourth optic 1315*d*, and the fourteenth light source 1318*d*, the fifteenth light source 1312*d*, and the sixteenth light source 1314*d* may be arranged at positions that are off-center with respect to the fourth optical axis of the fourth optic 1315*d*.

The second light source 1318*a* may be arranged on the west side of the first light source 1310*a*, the sixth light source 1318*b* may be arranged on the west side of the fifth light source 1310*b*, the tenth light source 1318*c* may be arranged on the west side of the ninth light source 1310*c*, and the fourteenth light source 1318*d* may be arranged on the west side of the thirteenth light source 1310*d*. The third light source 1312*a* may be arranged on the south side of the first light source 1310*a*, the seventh light source 1312*b* may be arranged on the south side of the fifth light source 1310*b*, the eleventh light source 1312*c* may be arranged on the south side of the ninth light source 1310*c*, and the fifteenth light source 1312*d* may arranged on the south side of the thirteenth light source 1310*d*. The fourth light source 1314*a* may be arranged on the east side of the first light source 1310*a*, the eighth light source 1314*b* may be arranged on the east side of the fifth light source 1310*b*, the twelfth light source 1314*c* may be arranged on the east side of the ninth light source 1310*c*, and the sixteenth light source 1314*d* may arranged on the east side of the thirteenth light source 1310*d*.

The first light source 1310*a*, the eighth light source 1314*b*, the eleventh light source 1312*c*, and the fourteenth light source 1318*d* may have a first CCT. The second light source 1318*a*, the fifth light source 1310*b*, the twelfth light source 1314*c*, and the fifteenth light source 1312*d* may have a second CCT. The third light source 1312*a*, the sixth light source 1318*b*, the ninth light source 1310*c*, and the sixteenth light source 1314*d* may have a third CCT. The fourth light source 1314*a*, the seventh light source 1312*b*, the tenth light source 1318*c*, and the thirteenth light source 1310*d* may have a fourth CCT.

Figure 14:
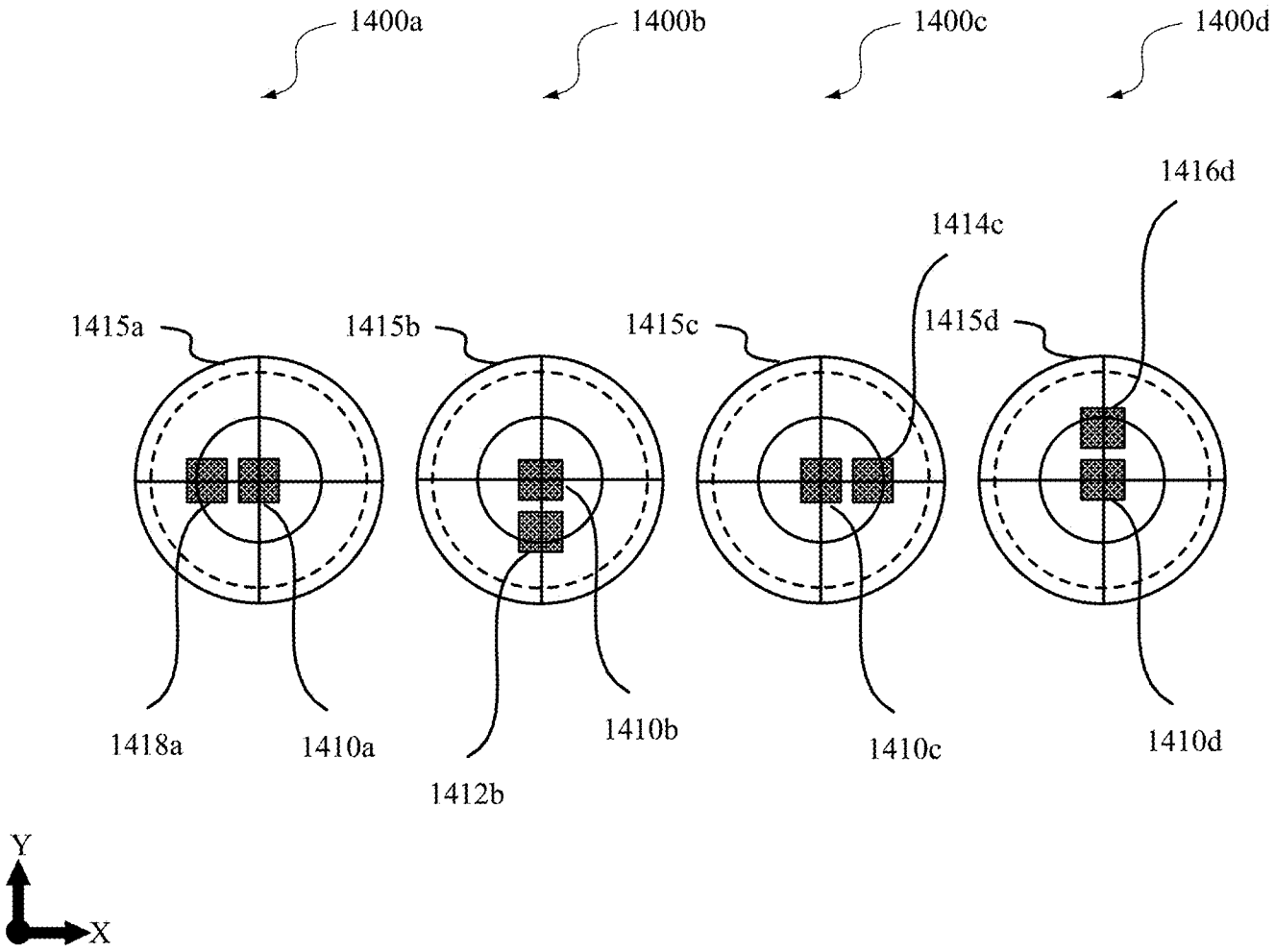
FIG. 14 is a schematic diagram of a lighting apparatus that may be used to provide a light distribution having a single CCT.

FIG. 14 is a schematic diagram of a lighting apparatus that may be used to provide a light distribution having a single CCT. Each light fixture may include a rotationally symmetric optic and two light sources. One of the light sources is centered with respect to the optic, and the other one of the light sources is off-center with respect to the optic. In this example, it may be unnecessary to provide pairs of light fixtures. The pattern of light sources within the light fixtures may rotate to provide a more symmetric light distribution. Arranging two light sources having the same CCT under a single optic may double the intensity of the light distribution and decrease the number of optics that are used, resulting in a smaller lighting apparatus. Further, increasing the number of fixtures and rotating the light sources within the fixtures may improve the light distribution.

FIG. 14 shows a top view of the lighting apparatus. As shown in FIG. 14, the lighting apparatus may include a first light fixture 1400*a*, a second light fixture 1400*b*, a third light fixture 1400*c*, and a fourth light fixture 1400*d*. Although four light fixtures are shown in FIG. 14, more or fewer light fixtures may be included. The first light fixture 1400*a* may include a first light source 1410*a*, a second light source 1418*a*, and a first optic 1415*a*, each of which may be rotationally symmetric. The first light source 1410*a* may be arranged at a position that is centered with respect to a first optical axis of the first optic 1415*a*, and the second light source 1418*a* may be arranged at a position that is off-center with respect to the first optical axis of the first optic 1415*a*. Similarly, the second light fixture 1400*b* may include a third light source 1410*b*, a fourth light source 1412*b*, and a second optic 1415*b*, each of which may be rotationally symmetric. The third light source 1410*b* may be arranged at a position that is centered with respect to a first optical axis of the second optic 1415*b*, and the fourth light source 1412*b* may be arranged at a position that is off-center with respect to the second optical axis of the second optic 1415*b*.

The third light fixture 1400*c* may include a fifth light source 1410*c*, a sixth light source 1414*c*, and a third optic 1415*c*, each of which may be rotationally symmetric. The fifth light source 1410*c* may be arranged at a position that is centered with respect to a third optical axis of the third optic 1415*c*, and the sixth light source 1414*c* may be arranged at a position that is off-center with respect to the third optical axis of the third optic 1415*c*. Similarly, the fourth light fixture 1400*d* may include a seventh light source 1410*d*, an eighth light source 1416*d*, and a fourth optic 1415*d*, each of which may be rotationally symmetric. The seventh light source 1410*d* may be arranged at a position that is centered with respect to a fourth optical axis of the fourth optic 1415*d*, and the eighth light source 1416*d* may be arranged at a position that is off-center with respect to the fourth optical axis of the fourth optic 1415*d*.

The second light source 1418*a* may be arranged on the west side of the first light source 1410*a*. The fourth light source 1412*b* may be arranged on the south side of the third light source 1410*b*. The sixth light source 1414*c* may be arranged on the east side of the fifth light source 1410*c*. The eighth light source 1416*d* may be arranged on the north side of the seventh light source 1410*d*. Some or all of the light sources may have the same CCT. In the example shown in FIG. 14, all of the light sources have the same CCT. This arrangement may allow the number of light sources in a fixture to be doubled without increasing the size of the optic or doubling the number of optics. Further, this arrangement may maintain a light distribution that is smooth and rotationally symmetric. Any of the lighting apparatuses described above may be modified to have some or all of the light sources with the same CCT.

In other examples, both light sources under a first optic may have the same CCT, and both light sources under a second optic may have a different CCT. For example, with reference to FIG. 14, the first light source 1410*a* and the second light source 1418*a* may have a first CCT, while the third light source 1410*b* and the fourth light source 1412*b* may have a second CCT.

In other examples, only one light source corresponding to each optic may have a different CCT than the other light sources. For example, with reference to the first triplet shown in FIG. 12, the first light source 1210*a*, the sixth light source 1212*b*, and the eighth light source 1218*c* may have a first CCT. The second light source 1218*a*, the third light source 1212*a*, the fourth light source 1210*b*, the fifth light source 1218*b*, the seventh light source 1210*c*, and the ninth light source 1212*c* may have a second CCT. The first CCT may be 1800 K and the second CCT may be 3000 K. This may provide a warm dim lighting apparatus in which the output of light having the second CCT is increased, while light having the first CCT is provided when the lighting apparatus is dimmed to low levels. By distributing the first light source 1210*a*, the sixth light source 1212*b*, and the eighth light source 1218*c* around the lighting apparatus, the light distribution from the dimmed lighting apparatus may be smooth and rotationally symmetric, such that the light distribution has similar characteristics to the light distribution at full brightness.

The lighting apparatuses discussed above include light fixtures that are arranged along a linear direction. Alternatively, the light fixtures may have various other configurations, such as a 2×2 array, a 3×3 array, a 4×6 array, or any other N×N or N×M array. The light fixtures may also be arranged in configurations having other shapes, such as octagonal, hexagonal, rectangular, or circular shapes. For example, circular shapes may be used for floodlights and/or downlights.

As discussed above, a light fixture may include an optic and a plurality of light sources. One of the light sources is centered with respect to the optic. At least one additional light source may be off-center with respect to the optic. The additional light sources may be positioned at a distance from the light source that is centered with respect to the optic. For example, with reference to FIG. 8, the second light source 812*a* may be positioned at a distance from the first light source 810*a*. The distance between the second light source 812*a* and the first light source 810*a* may be determined by a gap that is required by a machine that places each of the light sources on a substrate. Alternatively or in addition, the distance may be determined to prevent one of the light sources from interfering with or blocking light from another one of the light sources. Further, although the examples discussed above have additional light sources that are arranged north, east, south, or west of the light source that is centered with respect to the optic, the additional light sources may alternatively be arranged at other locations, such as northeast, southeast, southwest, or northwest of the light source that is centered with respect to the optic. However, because the additional light sources would be positioned farther from the light source that is centered with respect to the optic, the light distribution would be wider.

The methods, systems, and devices discussed above are examples. Various embodiments may omit, substitute, or add various procedures or components as appropriate. For instance, in alternative configurations, the methods described may be performed in an order different from that described, and/or various stages may be added, omitted, and/or combined. Also, features described with respect to certain embodiments may be combined in various other embodiments. Different aspects and elements of the embodiments may be combined in a similar manner. Also, technology evolves and, thus, many of the elements are examples that do not limit the scope of the disclosure to those specific examples.

Specific details are given in the description to provide a thorough understanding of the embodiments. However, embodiments may be practiced without these specific details. For example, well-known circuits, processes, systems, structures, and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing various embodiments. Various changes may be made in the function and arrangement of elements without departing from the spirit and scope of the present disclosure.

Terms, "and" and "or" as used herein, may include a variety of meanings that are also expected to depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein may be used to describe any feature, structure, or characteristic in the singular or may be used to describe some combination of features, structures, or characteristics. However, it should be noted that this is merely an illustrative example and claimed subject matter is not limited to this example. Furthermore, the term "at least one of" if used to associate a list, such as A, B, or C, can be interpreted to mean any combination of A, B, and/or C, such as A, AB, AC, BC, AA, ABC, AAB, AABBCCC, etc.

The specification and drawings are, accordingly, to be regarded in an illustrative rather than a restrictive sense. It will, however, be evident that additions, subtractions, deletions, and other modifications and changes may be made thereunto without departing from the broader spirit and scope as set forth in the claims. Thus, although specific embodiments have been described, these are not intended to be limiting. Various modifications and equivalents are within the scope of the following claims.

What is claimed is:

1. A lighting apparatus comprising:

a first light fixture comprising:

a plurality of light sources, the plurality of light sources comprising:

a first light source arranged at a first position that is centered with respect to a central optical axis of a first optic;

a second light source arranged at a second position that is off-center with respect to the central optical axis of the first optic, and a third light source arranged at a third position that is off-center with respect to the central optical axis of the first optic, wherein:

the first optic is configured to receive light emitted by the first light source, the second light source, and the third light source;

the first light source and the second light source are arranged along a first linear direction;

the first light source and the third light source are arranged along a second linear direction that is orthogonal to the first linear direction; and the plurality of light sources are asymmetrically arranged about the first linear direction and the second linear direction;

a second light fixture comprising:

a fourth light source arranged at a fourth position that is centered with respect to a central optical axis of a second optic; and a fifth light source arranged at a fifth position that is off-center with respect to the central optical axis of the second optic, wherein the second optic is configured to receive light emitted by the fourth light source and the fifth light source, wherein the first light fixture and the second light fixture comprise different layouts of light sources relative to one another.

2. The lighting apparatus of claim 1, wherein the first optic has a geometry that is rotationally symmetric about the central optical axis of the first optic.

3. The lighting apparatus of claim 1, wherein the first optic is configured to use total internal reflection (TIR).

4. The lighting apparatus of claim 1, wherein:

the first light source is configured to emit light having a first correlated color temperature (CCT), and the second light source is configured to emit light having a second CCT that is different from the first CCT.

5. The lighting apparatus of claim 1, wherein the first light source and the second light source are configured to emit light having a same correlated color temperature (CCT).

6. The lighting apparatus of claim 1, wherein:

the first light source and the second light source are configured to emit light having a first correlated color temperature (CCT), and the fourth light source and the fifth light source are configured to emit light having a second CCT that is different from the first CCT.

7. The lighting apparatus of claim 1, wherein:

the first light source and the fourth light source are configured to emit light having a first correlated color temperature (CCT), and the second light source and the fifth light source are configured to emit light having a second CCT that is different from the first CCT.

8. The lighting apparatus of claim 1, wherein the different layouts of light sources of the first light fixture and the second light fixture comprise light sources with different CCT layouts.

9. A lighting apparatus comprising:

a first light fixture comprising:

a plurality of light sources, the plurality of light sources comprising:

a first light source arranged at a first position that is centered with respect to a central optical axis of a first optic, wherein the first light source is configured to emit light having a first correlated color temperature (CCT); and a second light source arranged at a second position that is off-center with respect to the central optical axis of the first optic, wherein the second light source is configured to emit light having a second CCT, a third light source arranged at a third position that is off-center with respect to the central optical axis of the first optic, wherein:

the plurality of light sources are asymmetrically arranged about a first linear direction and a second linear direction;

the first optic is configured to receive the light emitted by the first light source, the second light source, and the third light source; and a second light fixture comprising:

a fourth light source arranged at a fourth position that is centered with respect to a central optical axis of a second optic, wherein the fourth light source is configured to emit light having the second CCT; and a fifth light source arranged at a fifth position that is off-center with respect to the central optical axis of the second optic, wherein:

the fifth light source is configured to emit light having the first CCT;

the second optic is configured to receive the light emitted by the fourth light source and the fifth light source;

the first position, the third position, and the fourth position are arranged along the first linear direction;

the first position and the second position are arranged along the second linear direction that is perpendicular to the first linear direction; and the second position and the fifth position are arranged along a third linear direction that is parallel to and spaced apart from the first linear direction, wherein the first light fixture and the second light fixture comprise different layouts of light sources relative to one another.

10. The lighting apparatus of claim 9, further comprising:

a third light fixture comprising:

a sixth light source arranged at a sixth position that is centered with respect to a central optical axis of a third optic, wherein the sixth light source is configured to emit light having the first CCT; and a seventh light source arranged at a seventh position that is off-center with respect to the central optical axis of the third optic, wherein the seventh light source is configured to emit light having the second CCT, wherein the third optic is configured to receive the light emitted by the sixth light source and the seventh light source; and a fourth light fixture comprising:

an eighth light source arranged at a eighth position that is centered with respect to a central optical axis of a fourth optic, wherein the eighth light source is configured to emit light having the second CCT; and a ninth light source arranged at a ninth position that is off-center with respect to the central optical axis of the fourth optic, wherein the ninth light source is configured to emit light having the first CCT, wherein the fourth optic is configured to receive the light emitted by the eighth light source and the ninth light source, and wherein:

the sixth position, the seventh position, the eighth position, and the ninth position are arranged along the first linear direction.

11. The lighting apparatus of claim 10, wherein:

the third light fixture comprises a tenth light source arranged at a tenth position that is off-center with respect to the central optical axis of the third optic;

the fourth light fixture comprises an eleventh light source arranged at an eleventh position that is off-center with respect to the central optical axis of the fourth optic; and the tenth light source and the eleventh light source are arranged along a fourth linear direction that is parallel to and spaced apart from the first linear direction and the third linear direction.

12. The lighting apparatus of claim 9, wherein the first CCT is between 1800 K and 3500 K, and the second CCT is between 4500 K and 7000 K.

13. The lighting apparatus of claim 9, further comprising:

a first texture that is configured to receive light from a first light emitting surface of the first optic; and a second texture that is configured to receive light from a second light emitting surface of the second optic.

14. A lighting apparatus comprising:

a first light fixture comprising:

a plurality of light sources, the plurality of light sources comprising:

a first light source arranged at a first position that is centered with respect to a central optical axis of a first optic;

a second light source arranged at a second position that is off-center with respect to the central optical axis of the first optic; and a third light source arranged at a third position that is off-center with respect to the central optical axis of the first optic, wherein:

the first optic is configured to receive light emitted by the first light source, the second light source, and the third light source;

the first light source and the second light source are arranged along a first linear direction;

the first light source and the third light source are arranged along a second linear direction that is orthogonal to the first linear direction; and the plurality of light sources are asymmetrically arranged about the first linear direction and the second linear direction;

a second light fixture comprising:

a fourth light source arranged at a fourth position that is centered with respect to a central optical axis of a second optic;

a fifth light source arranged at a fifth position that is off-center with respect to the central optical axis of the second optic; and a sixth light source arranged at a sixth position that is off-center with respect to the central optical axis of the second optic, wherein the second optic is configured to receive light emitted by the fourth light source, the fifth light source, and the sixth light source; and a third light fixture comprising:

a seventh light source arranged at a seventh position that is centered with respect to a central optical axis of a third optic;

an eighth light source arranged at an eighth position that is off-center with respect to the central optical axis of the third optic; and a ninth light source arranged at a ninth position that is off-center with respect to the central optical axis of the third optic, wherein the third optic is configured to receive light emitted by the seventh light source, the eighth light source, and the ninth light source, and wherein the first light fixture, the second light fixture, and the third light fixture comprise different layouts of light sources relative to one another.

15. The lighting apparatus of claim 14, wherein:

the first light source, the sixth light source, and the eighth light source are configured to emit light having a first correlated color temperature (CCT), the second light source, the fourth light source, and the ninth light source are configured to emit light having a second CCT that is different from the first CCT, and the third light source, the fifth light source, and the seventh light source are configured to emit light having a third CCT that is different from the first CCT and the second CCT.

16. The lighting apparatus of claim 15, wherein the first CCT is between 1800 K and 3500 K, the second CCT is between 4500 K and 5500 K, and the third CCT is between 5600 K and 7000 K.

17. The lighting apparatus of claim 14, wherein:

the first light source, the sixth light source, and the eighth light source are configured to emit light having a first wavelength, the second light source, the fourth light source, and the ninth light source are configured to emit light having a second wavelength, and the third light source, the fifth light source, and the seventh light source are configured to emit light having a third wavelength.

18. The lighting apparatus of claim 17, wherein:

the first wavelength is within a first portion of the electromagnetic spectrum corresponding to red light, the second wavelength is within a second portion of the electromagnetic spectrum corresponding to green light, and the third wavelength is within a third portion of the electromagnetic spectrum corresponding to blue light.

19. The lighting apparatus of claim 14, wherein:

the second position, the first position, the fifth position, the fourth position, the eighth position, and the seventh position are arranged in order along the first linear direction, the first position and the third position are arranged along the second linear direction that is orthogonal to the first linear direction, the third position, the sixth position, and the ninth position are arranged along a third linear direction that is parallel to the first linear direction, the fourth position and the sixth position are arranged along a fourth linear direction that is perpendicular to the first linear direction and parallel to the second linear direction, and the seventh position and the ninth position are arranged along a fifth linear direction that is perpendicular to the first linear direction and parallel to the second linear direction.

* * * * *